US009234714B2

(12) United States Patent
Castro et al.

(10) Patent No.: US 9,234,714 B2
(45) Date of Patent: Jan. 12, 2016

(54) MAGAZINE AND FIREARM WITH POSITIONAL ADJUSTMENT OF MAGAZINE SPRING

(71) Applicants: Christopher R. Castro, Richardson, TX (US); Dana D. Huffman, Richardson, TX (US)

(72) Inventors: Christopher R. Castro, Richardson, TX (US); Dana D. Huffman, Richardson, TX (US)

( * ) Notice: Subject to any disclaimer, the term of this patent is extended or adjusted under 35 U.S.C. 154(b) by 0 days.

(21) Appl. No.: 13/998,621

(22) Filed: Nov. 18, 2013

(65) Prior Publication Data

US 2014/0283427 A1 Sep. 25, 2014

Related U.S. Application Data

(63) Continuation-in-part of application No. 12/804,683, filed on Jul. 27, 2010, now abandoned.

(51) Int. Cl.

| | |
|---|---|
| ***F41A 9/67*** | (2006.01) |
| ***F41A 9/83*** | (2006.01) |
| ***F41C 23/22*** | (2006.01) |

(52) U.S. Cl.

CPC ... *F41A 9/67* (2013.01); *F41A 9/83* (2013.01); *F41C 23/22* (2013.01)

(58) Field of Classification Search

CPC ..... F41A 9/65; F41A 9/64; F41A 9/70; F41A 9/00; F41A 9/61; F41A 9/69; F41A 9/71; F41A 9/55; F41A 9/82; F41A 9/01; F41A 9/54; F41A 9/66; F41A 35/00

USPC ..... 42/6, 49.01, 49.02, 50, 49.1, 70.02; 89/195, 197, 33.1

See application file for complete search history.

(56) References Cited

U.S. PATENT DOCUMENTS

| | | | | |
|---|---|---|---|---|
| 1,299,303 | A * | 4/1919 | Cowles | 42/50 |
| 2,137,491 | A * | 11/1938 | Huff | 42/90 |
| 2,620,582 | A * | 12/1952 | Stukas | 42/50 |
| 4,430,821 | A | 2/1984 | Vincent | |
| 4,488,371 | A * | 12/1984 | Boyles | 42/90 |
| 4,872,279 | A * | 10/1989 | Boat | 42/90 |
| 4,977,815 | A | 12/1990 | Stephens | |
| 4,995,179 | A | 2/1991 | Switzer | |
| 5,074,070 | A | 12/1991 | Kuykendall | |
| 5,081,778 | A | 1/1992 | Switzer | |
| 5,225,613 | A | 7/1993 | Claridge | |
| 5,402,594 | A | 4/1995 | Switzer | |
| 5,495,687 | A | 3/1996 | Waiser | |
| 7,200,964 | B2 | 4/2007 | Gates | |
| 7,497,044 | B2 | 3/2009 | Cammenga et al. | |
| 8,316,567 | B2 * | 11/2012 | Douglas | 42/50 |
| 2005/0150148 | A1 * | 7/2005 | Herpel | 42/50 |
| 2005/0188579 | A1 | 9/2005 | Gates | |
| 2011/0030259 | A1 * | 2/2011 | Castro et al. | 42/6 |
| 2011/0107639 | A1 * | 5/2011 | Douglas | 42/50 |
| 2013/0255125 | A1 * | 10/2013 | Bath | 42/50 |

* cited by examiner

*Primary Examiner* — Benjamin P Lee
(74) *Attorney, Agent, or Firm* — Scott B. Stahl

(57) ABSTRACT

A firearm magazine housing contains a spring to forcibly urge a follower with ammunition rounds stacked thereon toward an open end of the housing, thereby to facilitate delivery of the ammunition rounds into the firing chamber of a firearm. By a positional adjustment of the spring, the urging force that the spring applies to the follower during loading of ammunition rounds is reduced.

19 Claims, 30 Drawing Sheets

MAGAZINE AND FIREARM WITH POSITIONAL ADJUSTMENT OF MAGAZINE SPRING

This application is a continuation-in-part under 35 USC 120 of co-pending U.S. application Ser. No. 12/804,683, which was filed Jul. 27, 2010, and which claims priority under 35 USC 119(e)(1) to U.S. Provisional Application No. 61/273,643, which was filed Aug. 6, 2009. Both of the aforementioned prior applications are incorporated herein by reference.

FIELD OF THE INVENTION

The invention relates generally to firearms and, more particularly, to loading ammunition rounds into firearms.

BACKGROUND OF THE INVENTION

Conventional firearm magazines require manual loading of ammunition rounds one at a time through an upper opening into the magazine, progressively overcoming increasing resistance of a magazine spring. In general, as each ammunition round is loaded, it is pressed against a previously loaded round. This loading operation requires increasing force as more rounds are loaded into the magazine and the magazine spring is progressively compressed. This loading operation thus requires the firearm user to apply progressively increasing loading forces with their finger, which in turn progressively increases the fatigue on the finger. Some people do not have the required finger strength to manually load a firearm magazine in this manner, or are simply unable to load the magazine to its designed ammunition round capacity.

Moreover, even those who are able to load the magazine to its full capacity are typically unable to load the last several ammunition rounds as quickly as the first several ammunition rounds were loaded.

It is therefore desirable to provide for easing the aforementioned difficulties associated with loading ammunition rounds into a conventional firearm magazine.

DETAILED DESCRIPTION

Figure 1:
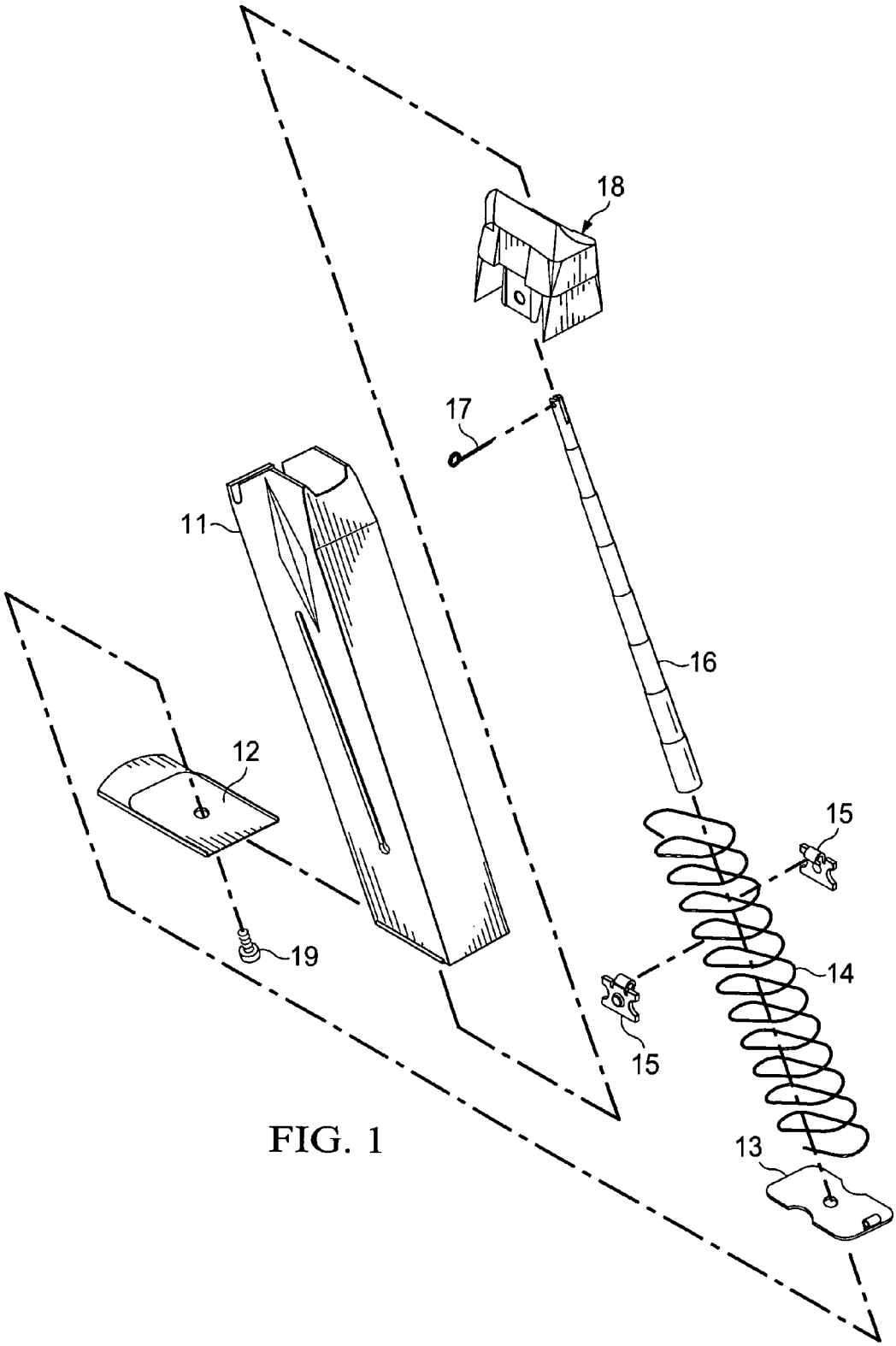
FIG. 1 is an exploded view of a firearm magazine according to exemplary embodiments of the invention.

FIG. 1 is an exploded view of the components of a firearm magazine according to exemplary embodiments of the invention. As shown in FIG. 1, the magazine includes a housing 11 that is closed at its lower end by a lower floor plate 12, on which is seated an upper floor plate 13. The upper floor plate 13 holds a magazine spring 14 that extends upwardly into the housing 11. A pair of lock plates 15 are attached to a coil in the upper half of the magazine spring 14.

The magazine of FIG. 1 further includes a follower 18 that is supported for movement within the housing 11 by a follower support apparatus including a telescoping member 16, a pin 17, and a threaded fastener 19. An upper end of the telescoping member 16 is pinned to the follower 18 using the pin 17. The threaded fastener 19 (for example, a screw) extends through aligned holes within the lower and upper floor plates 12 and 13 into a threaded opening at a lower end of the telescoping member 16 in order to fasten the telescoping member 16 to the closed lower end of the housing 11.

Figure 2:
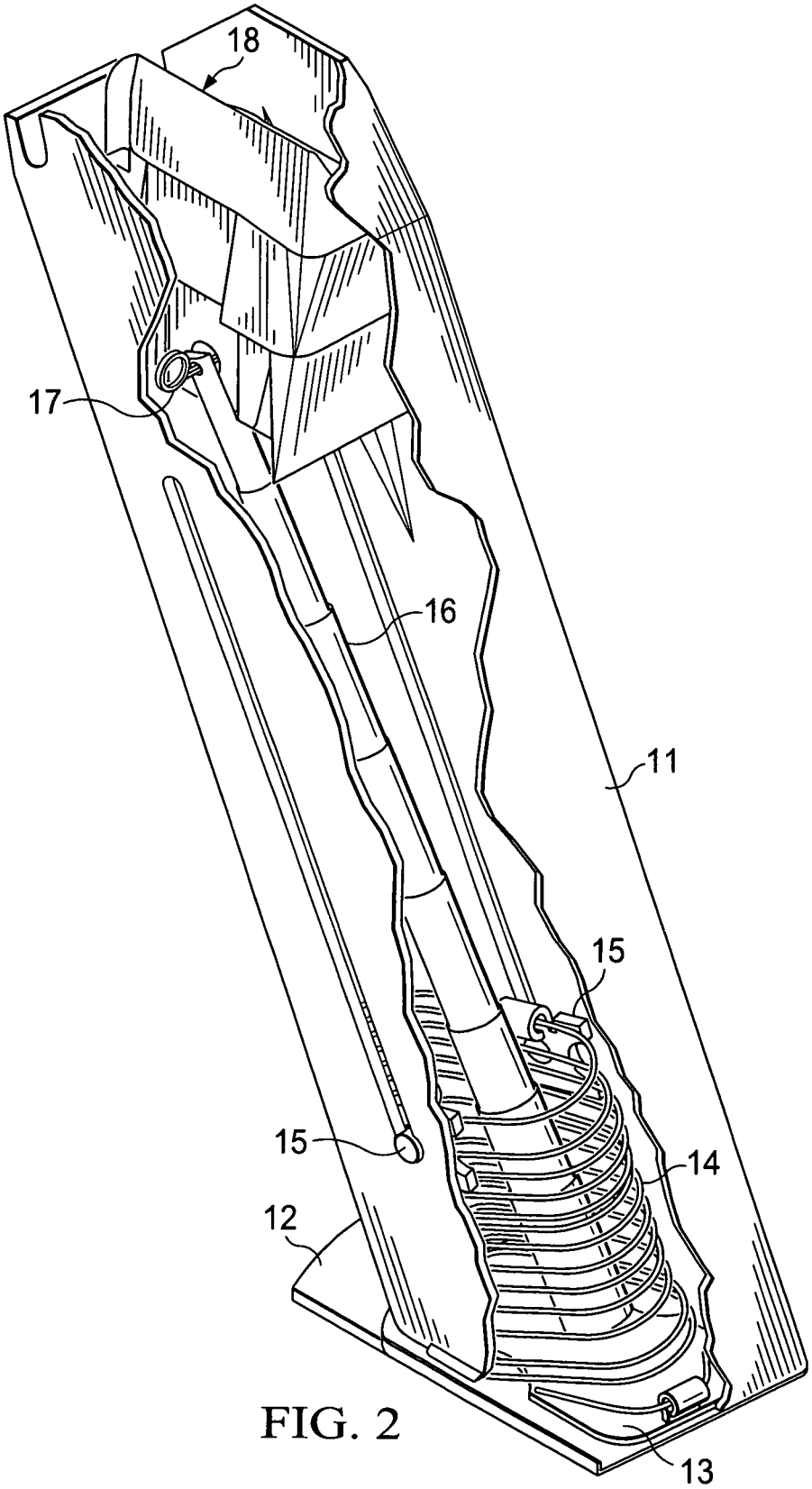
FIG. 2 is a cutaway view of the magazine of FIG. 1 assembled and prepared for loading according to exemplary embodiments of the invention.

FIG. 2 illustrates a magazine produced by assembling the components of FIG. 1. A portion of the housing 11 is cut away in FIG. 2 in order to reveal the components within the housing 11. In the illustration of FIG. 2, the lock plates 15 engage with the housing 11 to retain the magazine spring 14 in a compressed position within a lower portion of the housing 11, while the telescoping member 16 supports the follower 18 at the open, upper end of the housing 11.

Figure 3:
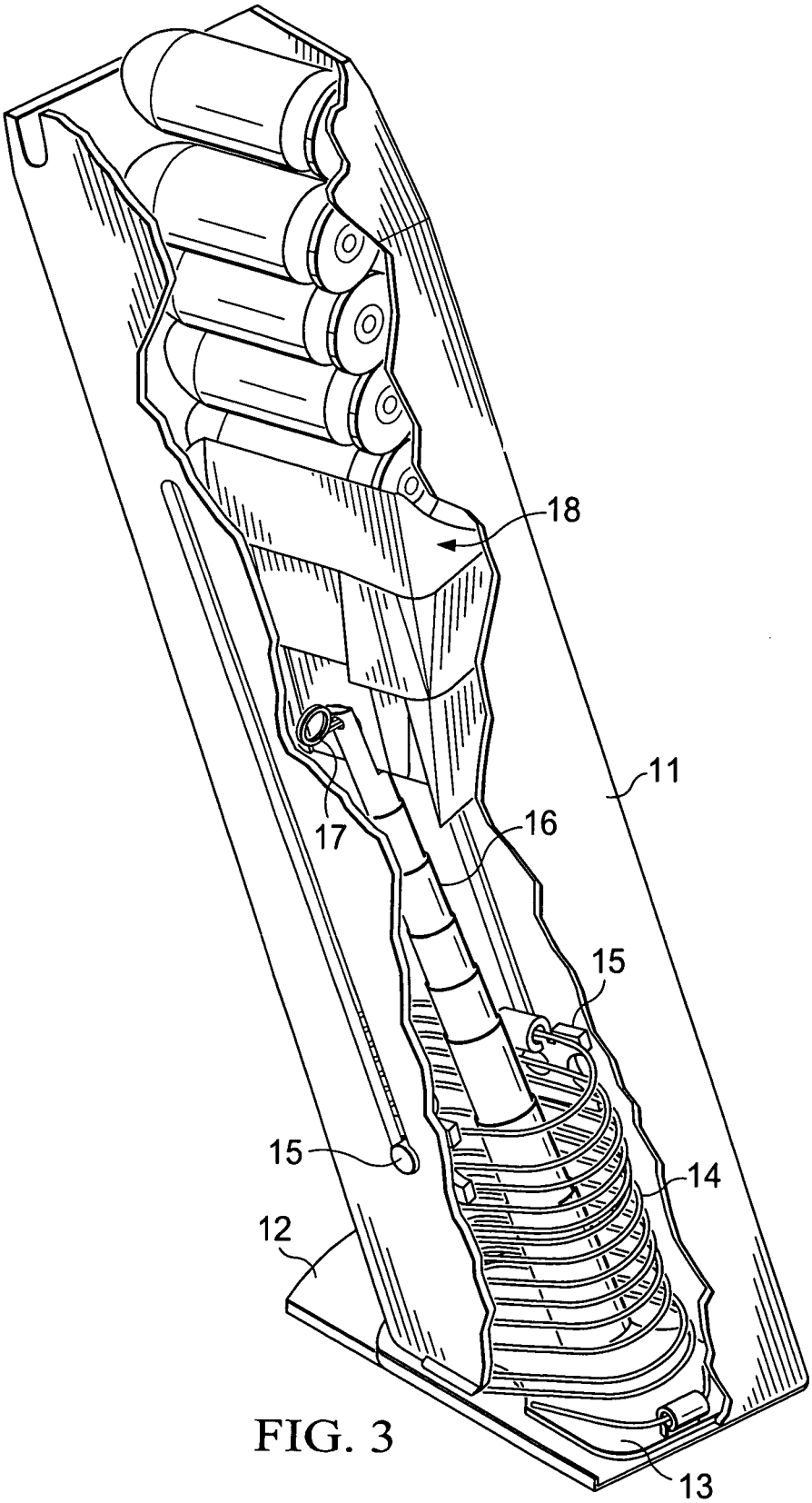
FIG. 3 is a cutaway view of the assembled magazine of FIG. 1 during loading according to exemplary embodiments of the invention.

FIG. 3 illustrates that the telescoping member 16 supports the follower 18 for movement from the open upper end of housing 11 toward the closed lower end, thereby permitting ammunition rounds to be progressively stacked onto the follower 18. In some embodiments, the telescoping member 16 is mechanically constructed in generally the same manner as a conventional collapsible pointer or radio antenna. The telescoping member 16 progressively retracts as the ammunition rounds are loaded onto the follower 18. When the magazine is fully loaded with ammunition rounds, the lock plates 15 can be disengaged from the housing 11, thereby permitting the magazine spring 14 to forcibly urge the follower 18 upwardly within the housing, as in conventional magazines. As the magazine is progressively emptied to load ammunition rounds into the firing chamber, the telescoping member 16 extends progressively upwardly with upward movement of the follower 18 as urged by the spring 14. It can be seen from FIG. 3 that the telescoping member 16 permits the ammunition rounds to be stacked onto the follower 18 independently of the magazine spring 14 and its forcible upward urging. Moreover, the telescoping member 16 does not apply forcible upward urging to the follower 18 during loading of the ammunition rounds, but supports the follower 18 for progressively downward motion as the ammunition rounds are progressively stacked onto the follower 18, overcoming the relatively small resistance provided by the telescoping member 16.

Figure 4:
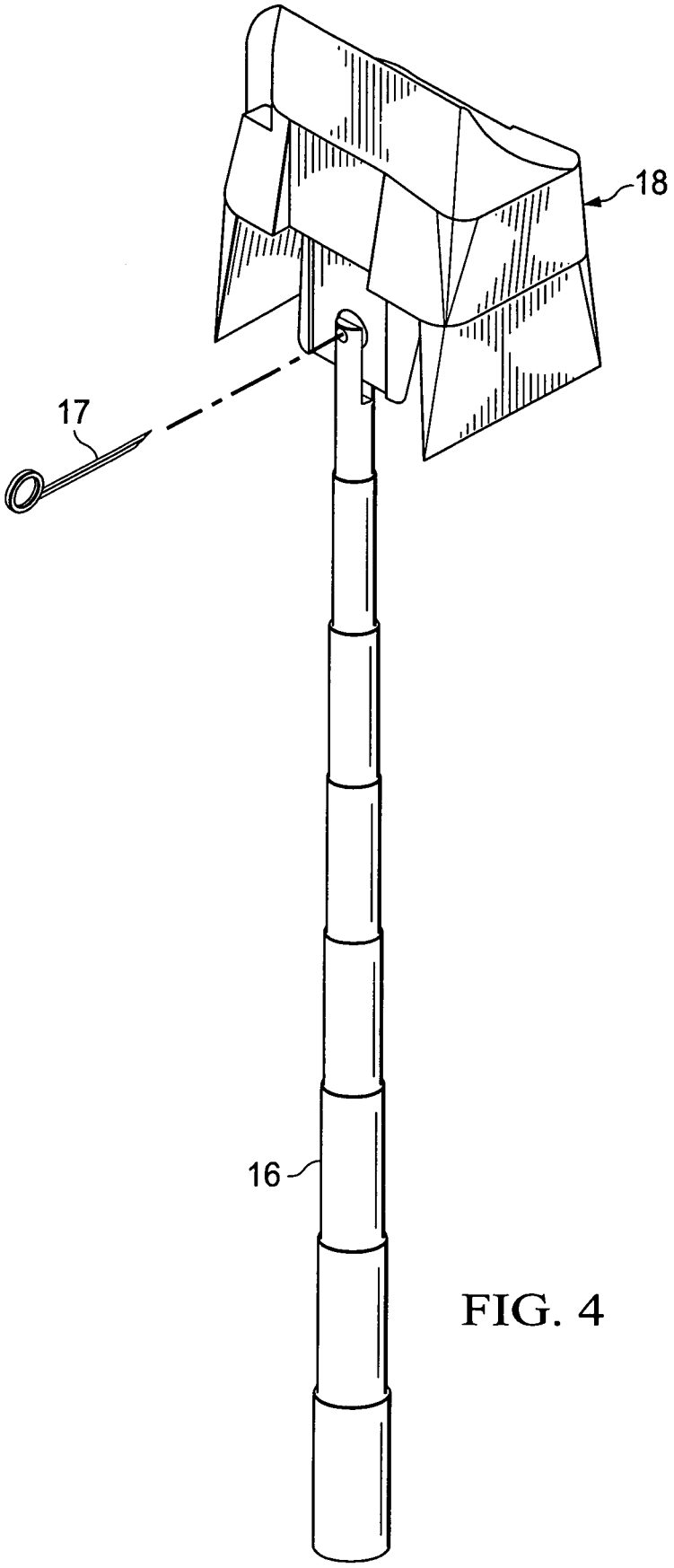
FIGS. 4-8E illustrate portions of the follower support apparatus of FIGS. 1-3 in more detail.

FIG. 4 illustrates the use of the pin 17 to connect the upper end of the telescoping member 16 to the follower 18. The upper end of the telescoping member 16 thus travels for movement with the follower 18.

Figure 5:
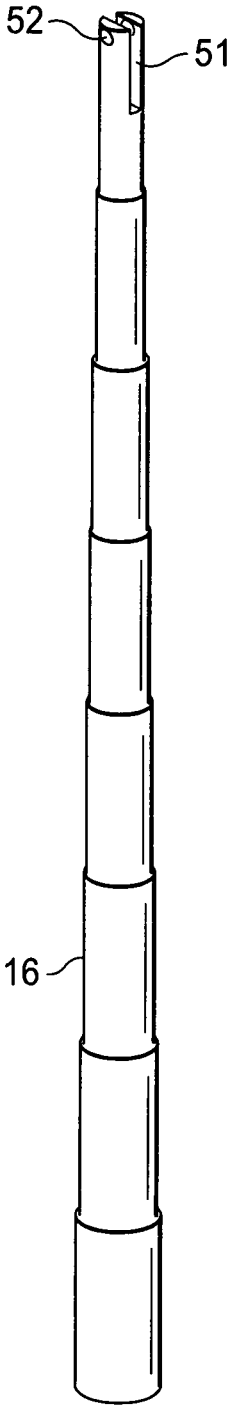

As shown in FIG. 5, the telescoping member 16 includes a plurality of telescoped sections. The top-most of these telescoped sections has defined therein a slot 51 that extends radially through and downwardly into the telescoping member 16. The slot 51 is defined between first and second upper end portions of the top-most telescoped section. These first and second upper end portions are disposed in generally opposed relationship to one another at opposite sides of the slot 51. The first and second upper end portions contain thru holes that are generally aligned with one another such that the pin 17 of FIG. 4 can be inserted into and passed through both of the thru holes and the slot 51 therebetween. One of the thru holes 52 is visible in FIG. 5.

Figure 6:
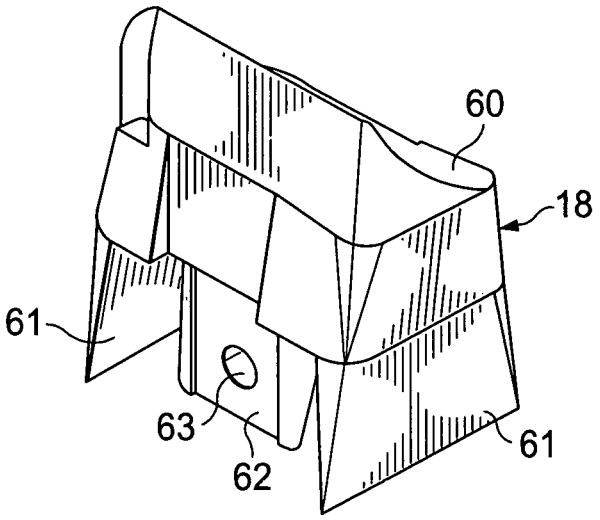

FIG. 6 illustrates the follower 18 in more detail. The follower 18 has an upper surface 60 on which ammunition rounds are stacked, as is conventional. The follower 18 further includes a generally conventional spring catch structure including a pair of flanges 61 that extend downwardly on opposite sides of a central follower extension portion 62. However, unlike the conventional spring catch structure, the follower extension portion 62 of FIG. 6 includes a thru hole 63 for receiving the pin 17 of FIGS. 1-4. As can be seen from FIGS. 1-6, when the telescoping member 16 is fastened to the follower 18, the extended support portion 62 of the follower 18 is received within the slot 51 of the telescoping member 16 with the hole 62 of the follower 18 aligned with the holes 52 of the telescoping member 16. With the telescoping member 16 and the follower 18 in this position relative to one another, the pin 17 can be inserted into and passed through the thru holes 52 and 62, and the slot 51, in order to fasten the follower 18 to the top-most telescoped section of the telescoping member 16.

Figure 7:
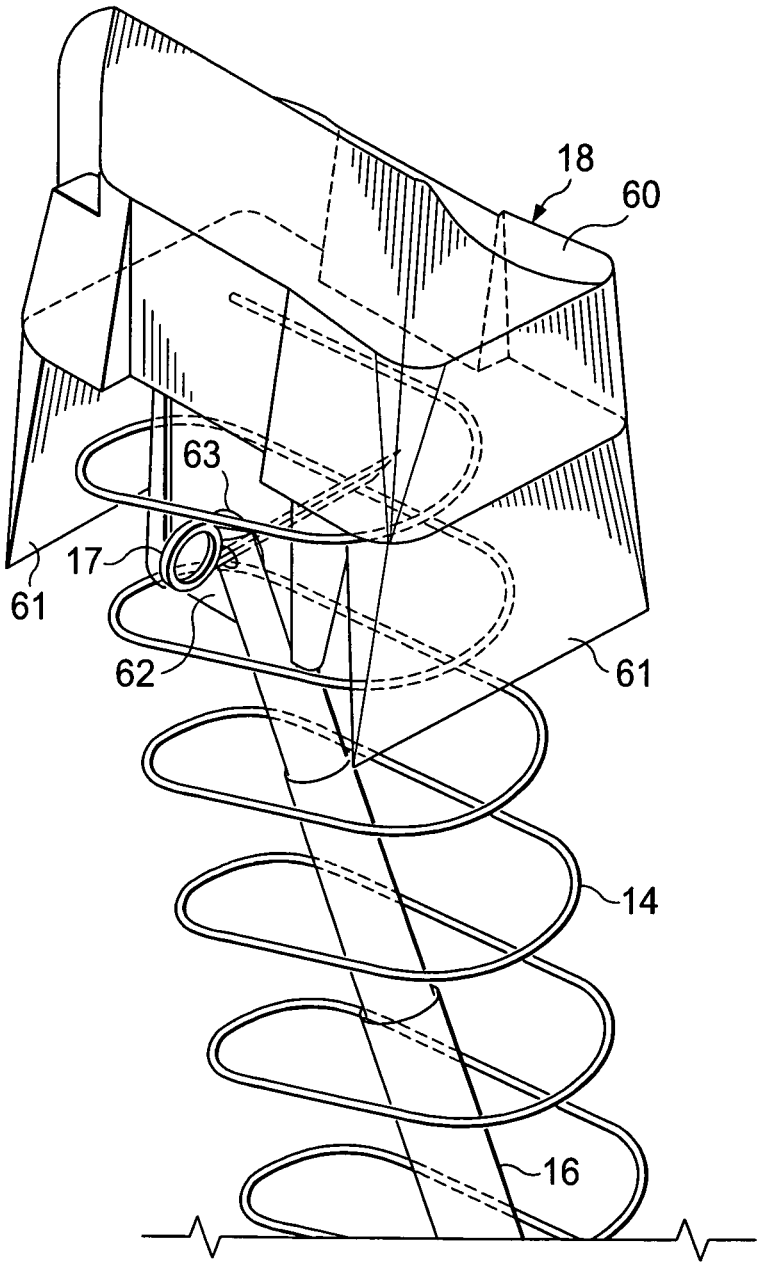

FIG. 7 illustrates the magazine spring 14 engaged with the spring catch structure 61, 62 of the follower 18, with the follower 18 also fastened to the telescoping member 16 by the pin 17.

FIGS. 8A-8E provide various illustrations of an exemplary embodiment 15A of the lock plate 15 of FIGS. 1-3. The lock plate 15A of FIGS. 8A-8E includes an upper curved portion 80, and a centrally located, spring-loaded lock button 81. A selected coil of the magazine spring 14 is received inside and extends through the space surrounded by the curved portion 80, in order to attach the lock plate 15A to the spring 14 (see also FIGS. 1-3). When so attached to the spring 14, the lock plate 15A depends downwardly from the attached coil of the spring 14, with the lock button firmly pressed against the inside wall of the housing 11 by the magazine spring 14 pressing radially outwardly on the surface of the lock plate 15A opposite the lock button 81. A suitable mechanism (described hereinafter) is used to compress the magazine spring 14 downwardly into a lower portion of the housing 11. This compression of the magazine spring 14 causes the two attached lock plates 15A to be carried downwardly in the housing 11 on the spring 14. At the end of this downward motion, the lock buttons 81 eventually become engaged within suitable openings in sidewalls of the housing 11.

Figure 8A:
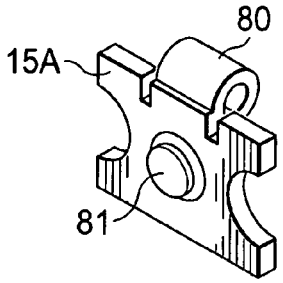
FIG. 8F illustrates a magazine housing with tapered sidewall portions according to exemplary embodiments of the invention.
Figure 8B:
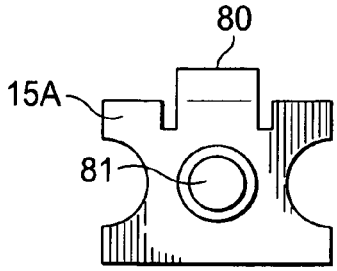
Figure 8C:
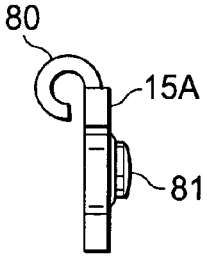
Figure 8D:
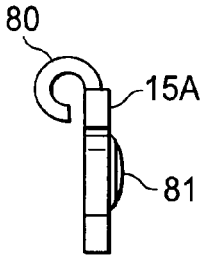
Figure 8E:
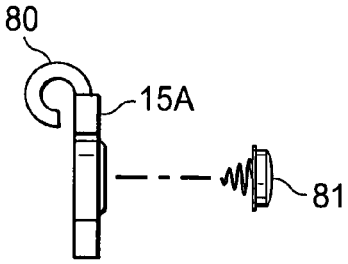
Figure 8F:
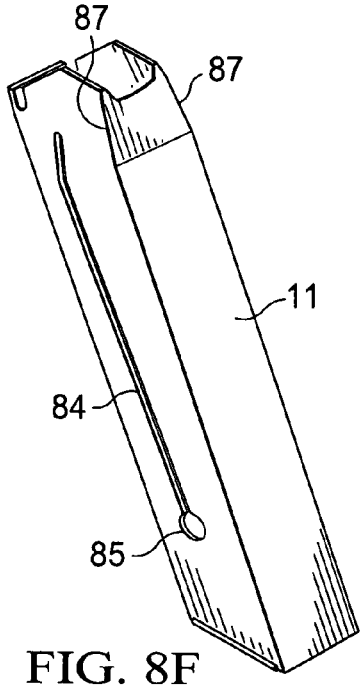

FIG. 8F illustrates the housing 11 in more detail according to exemplary embodiments of the invention. In particular, FIG. 8F shows a generally circular opening 85 in one of the sidewalls of the housing 11. Another such opening (not visible in FIG. 8F) is provided in the opposite sidewall of housing 11. The openings 85 are large enough to receive therein the lock buttons 81 of the lock plates 15A. As the lock plates 15A move downwardly in the housing 11 together with the spring 14, the lock buttons 81 eventually move into alignment with the openings 85 in the opposite sidewalls of the housing 11. With the lock buttons 81 thusly aligned with the openings 85, the spring-loading of the lock buttons 81 forces them outwardly into the openings 85, thereby locking the magazine spring 14 in its compressed position in the lower portion of the housing 11 (see also FIGS. 2 and 3).

FIG. 8F also illustrates an elongated slot 84 in the sidewall of the housing 11. The slot 84 terminates adjacent the opening 85 as shown. Another such elongated slot (not visible in FIG. 8F) is provided in the opposite sidewall of the housing 11 and contiguous with the opening 85 in that sidewall. The elongated slots 84 have a width that is narrower than a radius of the lock buttons 81, thereby preventing the lock buttons 81 from insertion into the slots 84. The elongated slots 84 provide access for insertion of a suitable tool into the interior of the housing 11 in order to apply a downwardly directed force to the magazine spring 14, and thereby permit the magazine spring 14 to be compressed downwardly far enough for the lock buttons 81 to engage with the openings 85. FIG. 8F also illustrates that the sidewalls of housing 11 extend generally parallel to one another from the closed lower end toward the open upper end, but taper inwardly toward each other near the upper end. The elongated slots 84 have respective upper portions that are located in the inwardly tapered portions 87 of the associated sidewalls.

FIG. 8E illustrates the spring loading of the lock button 81, FIG. 8D illustrates the compressed position of the lock button 81 when firmly pressed against the interior surface of the housing 11 by the spring 14 prior to engagement with the opening 85, and FIG. 8C illustrates the position of the lock button 81 when urged into the opening 85 via the spring-loading force.

Figure 9:
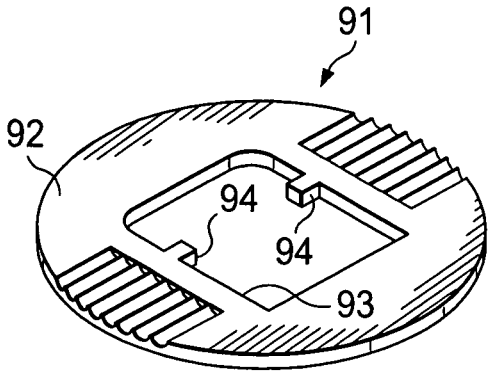
FIGS. 9 and 10 illustrate magazine spring compression tools according to exemplary embodiments of the invention.

FIG. 9 illustrates a spring compression tool 91 according to exemplary embodiments of the invention. The tool 91 has a plate-like, generally disc-shaped base portion 92 with a central opening 93 defined therein. The opening 93 is configured to conform with a transverse cross-sectional shape of the housing 11, thereby permitting the housing 11 to be received in, and passed longitudinally through the opening 93. A pair of contact portions 94 extend from the base portion 92 into the opening 93 in a generally opposed relationship to one another. When the housing 11 is received (upper end first) within the opening 93, the contact portions 94 are inserted into the upper portions of the elongated slots 84 (see also FIG. 8F) for engagement against a coil of the magazine spring 14, for example, the coil on which the lock plates 15A are carried, or another coil above the lock plates. When a force is applied to the base portion 92 in a direction toward the floor plates 12 and 13 (see FIGS. 1-3), the contact portions 94 transmit this force onto the engaged coil of magazine spring 14, thereby causing compression of the spring. The base portion 92 has a plurality of ridges formed therein on opposite sides of the opening 93 in order to facilitate gripping and operating the tool 91 in the manner described above.

The aforementioned extension of the upper portions of the elongated slots 84 into the tapered sidewall portions 87 permits movement of the tool 91 downwardly toward the lower closed end of the housing 11 while the housing 11 is received within the opening 93, but without the contact portions 94 engaging the housing sidewalls until the contact portions 94 can be received in the upper portions of the elongated slots 84 in the tapered sidewall portions 87. Once the contact portions 94 are received in the slots 84, continued downward movement of the tool 91 relative to the housing 11 causes the tool 91 to pass beyond the tapered sidewall portions 87, so that the contact portions 94 extend further inwardly into the housing 11 through the slots 84 to contact the magazine spring 14.

Figure 10:
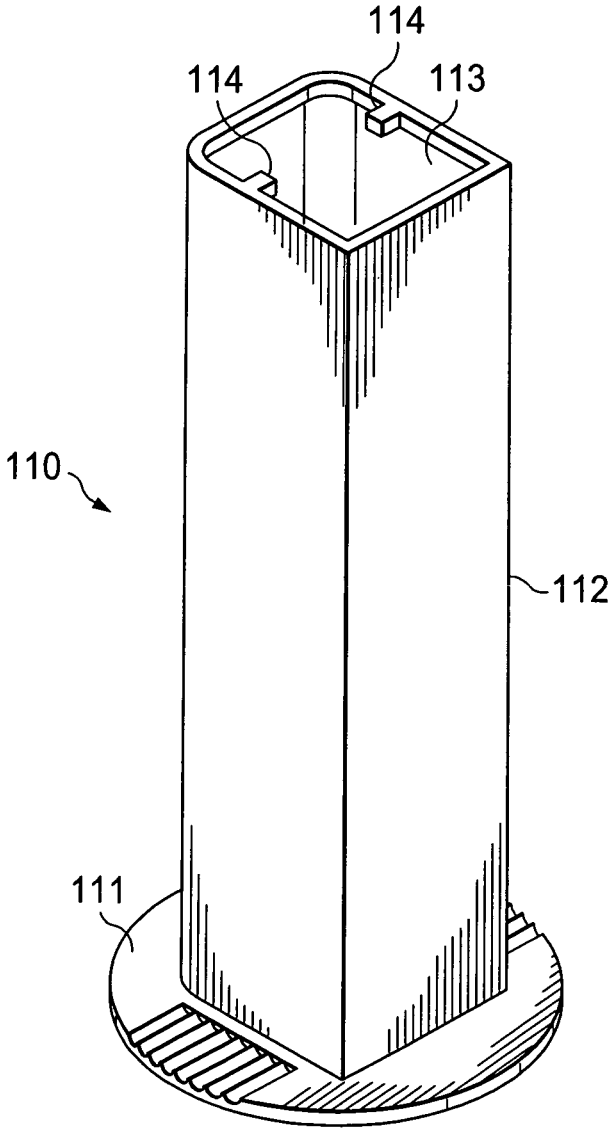

FIG. 10 illustrates another spring compression tool 110 according to exemplary embodiments of the invention. The tool 110 includes a grip portion 111 and a sleeve portion 112 extending away from the grip portion 111. The interior 113 of the sleeve portion 112 is configured to conform generally with a transverse cross section of the housing 11 to facilitate insertion of the housing 11 into the sleeve portion 112. Generally opposed contact portions 114 extend from the sleeve portion (also referred to as a base portion) 112 inwardly into the interior space 113 of the sleeve portion 112. A user can grasp the grip portion 111 in one hand and the housing 11 in the other hand, and insert the upper end of the housing 11 longitudinally into the interior space 113 of the sleeve portion 112 in a longitudinal direction. As the housing 11 advances into the sleeve portion 112, the opposed contact portions 114 are eventually received in the upper portions of the elongated slots 84. From this point, the operation of compressing the magazine spring 14 can proceed in generally the same manner described above with respect to the tool 91.

In some embodiments (shown in various ones of the drawing figures), the housing 11 does not have the tapered sidewall portions 87 of FIG. 8F. In such embodiments, any suitable tool, such as a rod or shaft, can be inserted transversely through the housing 11, via the elongate slots 84 in the sidewalls, to engage the magazine spring 14. The spring 14 can then be compressed by movement of the rod or shaft downwardly relative to the housing 11.

Figure 11:
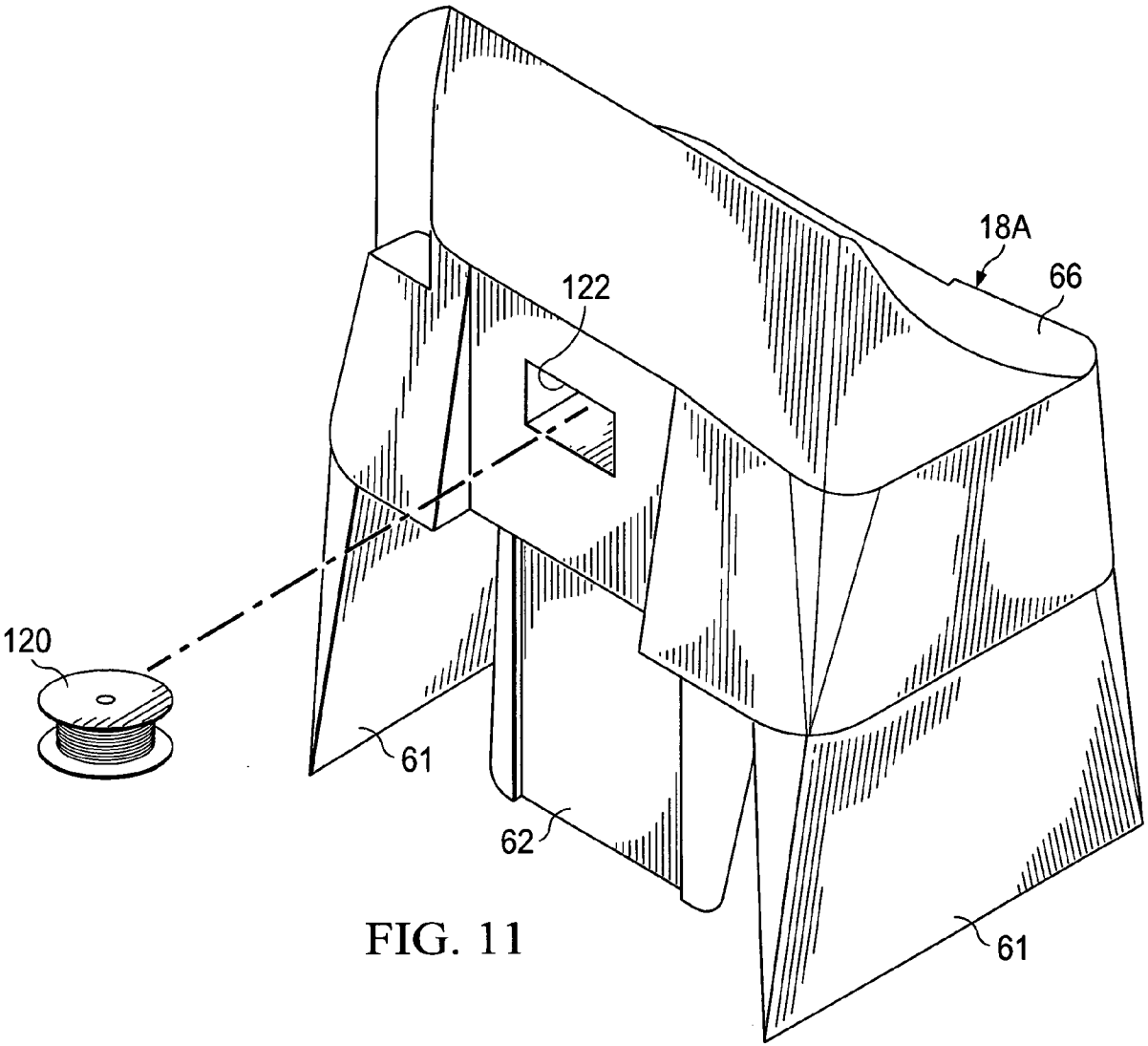
FIGS. 11-13 illustrate portions of the follower support apparatus of FIGS. 14 and 15 in more detail.
Figure 12:
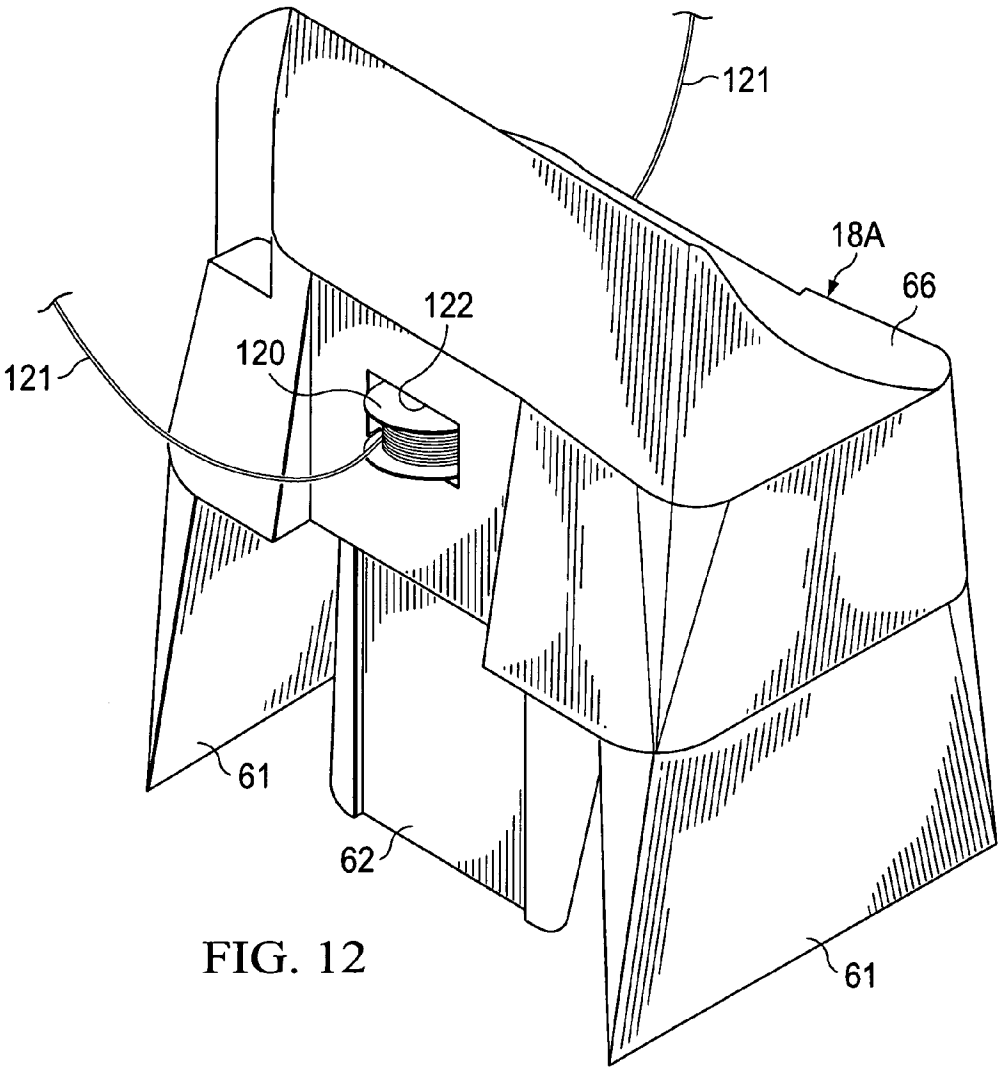

FIG. 11 illustrates a follower 18A according to further exemplary embodiments of the invention. The general structure of the follower 18A is similar to that of the follower 18 (see, e.g., FIG. 6), except a spring-loaded spool 120 is provided within a thru opening 122 defined within the follower 18A above the follower extension portion 62. As shown in FIG. 12, two elongate flexible members 121 are attached to the spring-loaded spool 120, and are extendable from the spool against the spring-loading force, and retractable onto the spool by action of the spring-loading force. In some embodiments, the elongate flexible members 121 are formed from a flexible metallic material. In various other embodiments, the elongate flexible members 121 are made of various other suitable flexible materials. In some embodiments, the elongate flexible members 121 are formed generally as a ribbon cable. In some embodiments, the elongate flexible members 121 are formed as cables with generally rounded or circular cross-sections. In some embodiments, the elongate flexible members are metallic and are themselves formed with a spring force characteristic that causes them to tend to wrap themselves around the spool 120.

Figure 13:
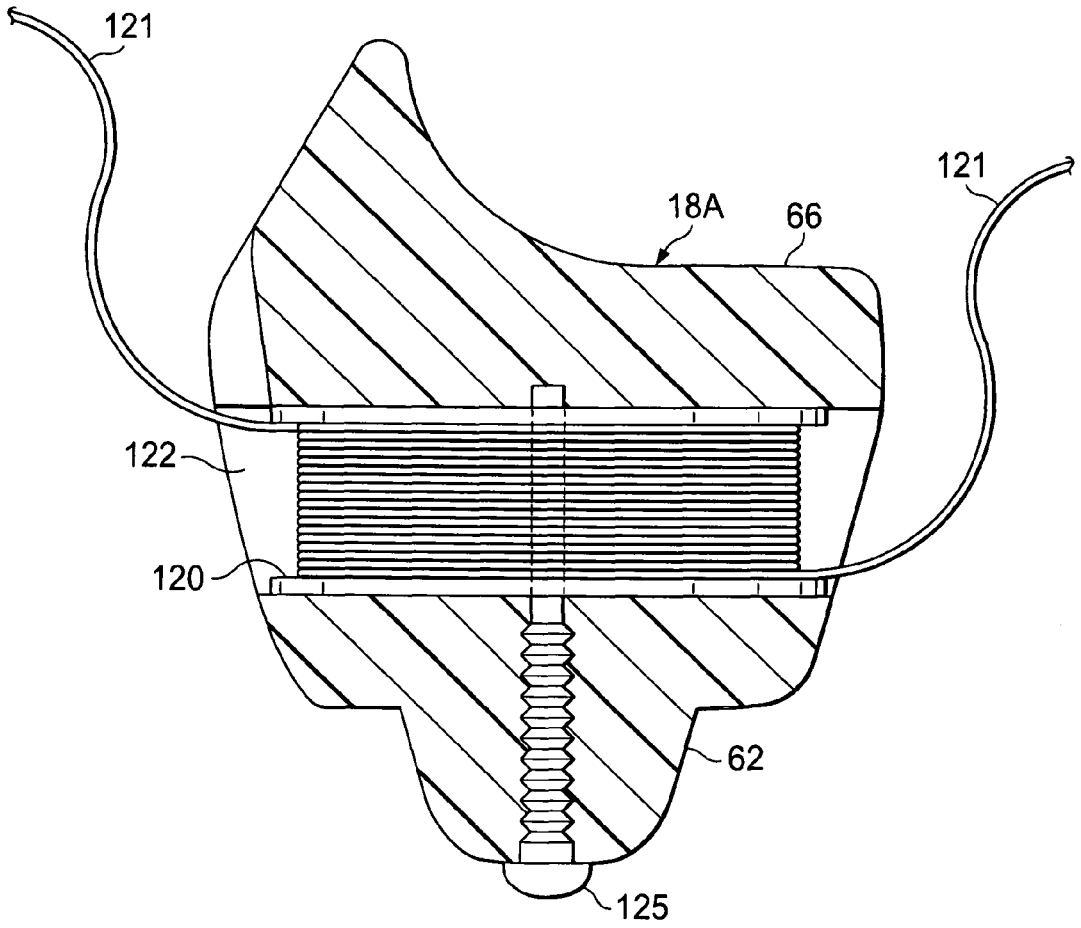

FIG. 13 is a cross-sectional view of the follower 18A, showing the mounting of the spool 120. The spool 120 is supported on a spindle shaft 125 for rotation within the opening 122. The spindle shaft 125 extends upwardly through the follower extension portion 62 and into the opening 122 located above the extension 62. The spindle shaft 125 includes a lower, fastening portion that engages with the extension 62 to fasten the spindle shaft 125 to the follower extension portion 62. In some embodiments, the fastening portion of the spindle shaft is threaded (as shown in FIG. 13) to facilitate threaded engagement within a thru hole extending from the bottom of the extension 62 to the opening 122. An upper portion of the spindle shaft 125 extends upwardly into the opening 122, and is received within a central opening of the spool 120 to support the spool 120 for rotation within the opening 122. In some embodiments, the lower end of the spindle shaft is formed as a screw head for ease of assembly.

Figure 14:
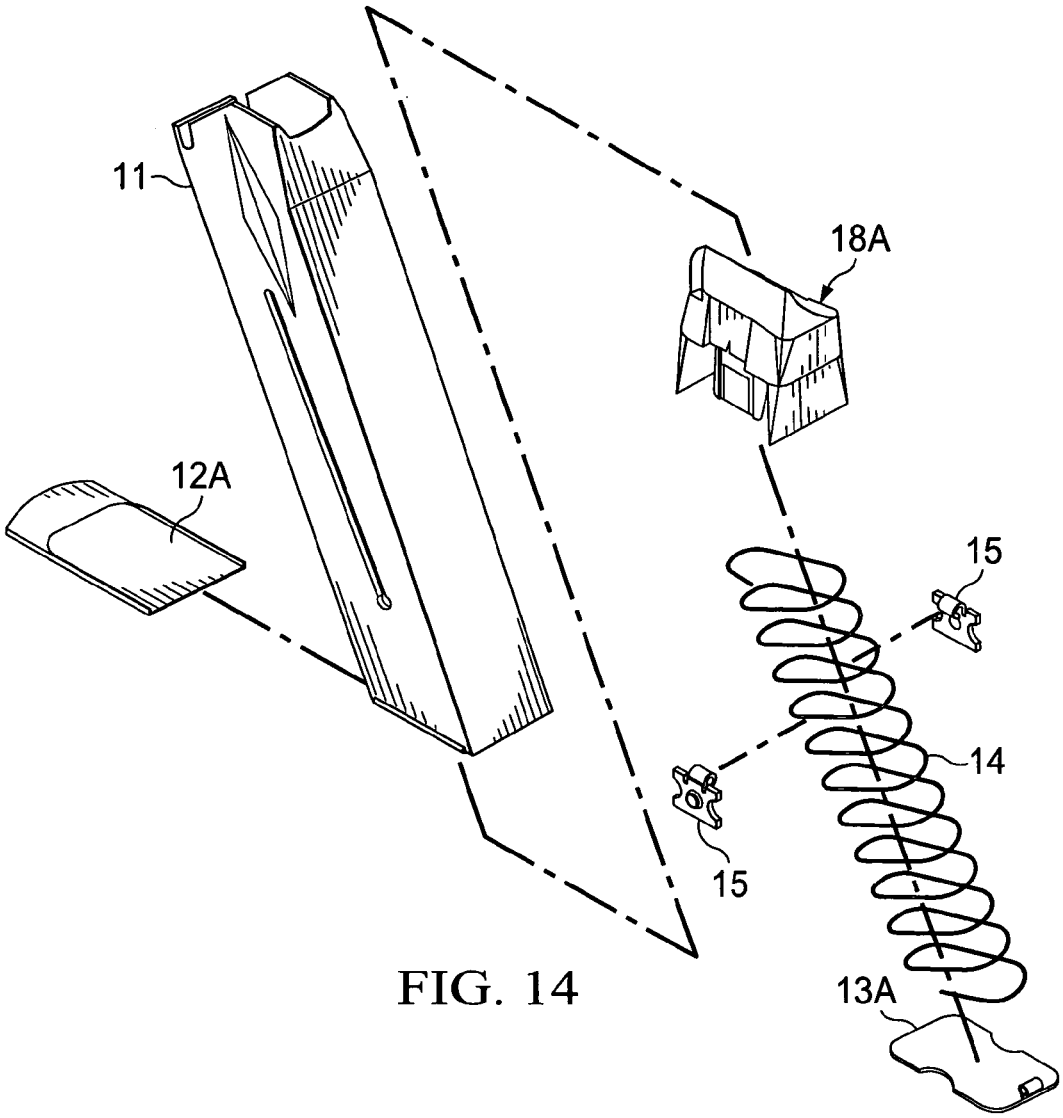
FIG. 14 is an exploded view of a further firearm magazine according to exemplary embodiments of the invention

FIG. 14 is an exploded view of the components of a further firearm magazine according to exemplary embodiments of the invention. The magazine of FIG. 14 is generally similar to the magazine of FIG. 1, except the follower 18A is fitted with a spring-loaded assembly (not explicitly shown in FIG. 14) that permits flexible elongate members (not explicitly shown in FIG. 14) such as described above to be extended from and retracted into the follower 18A as the follower 18A moves downwardly and upwardly, respectively, in the housing 11. In some embodiments, the spring loaded assembly includes the spool 120 described above with respect to FIGS. 11-13. Additionally, the lower and upper floor plates 12A and 13A in FIG. 12 do not require the thru holes provided in the floor plates 12 and 13 of FIG. 1.

Figure 15:
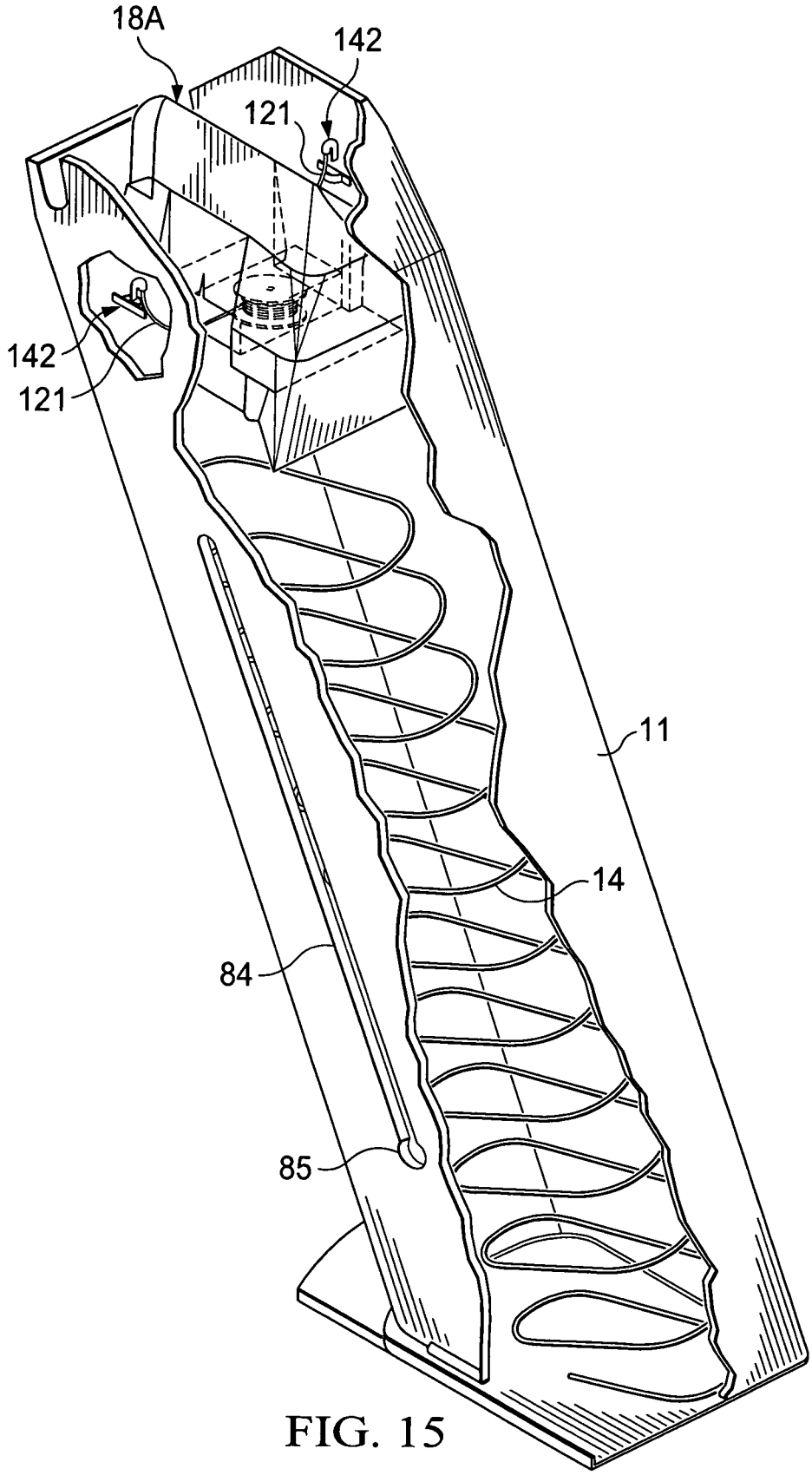
FIG. 15 is a cutaway view of a magazine of FIG. 14 partially assembled according to exemplary embodiments of the invention.

FIG. 15 illustrates a magazine produced by assembling the components of FIG. 14. A portion of the housing 11 is cut away in FIG. 15 in order to reveal the components within the housing 11. In the illustration of FIG. 15, the magazine spring 14 is in its uncompressed position. The lock plates 15 are not explicitly shown. As shown in FIG. 15, the elongate flexible members 121 extend from the spool 120 and terminate in engagement portions 142 that are adapted to engage with the inner sidewalls of the housing 11 to secure the elongate flexible members 121 to the housing 11.

Figure 16:
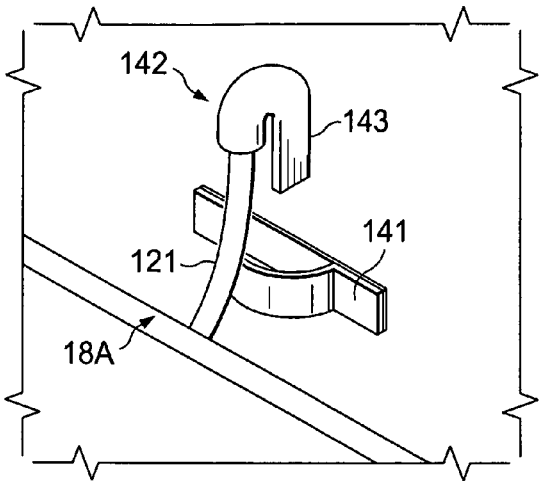
FIGS. 16-18 illustrate portions of the follower support apparatus of FIGS. 14 and 15 in more detail.

FIG. 16 illustrates a portion of FIG. 15 in more detail, showing the attachment of the elongate flexible members 121 to the inner sidewalls of the housing 11 according to exemplary embodiments of the invention. A pair of brackets 141 (one of which is shown in FIG. 16) are affixed to the upper interior sidewalls of the housing 11 in generally opposed relationship to one another. Each of the flexible elongate members 121 has provided on a free end thereof an engagement portion 142 that engages a corresponding one of the brackets 141 in order to secure the respective free ends of the members 121 against movement relative to the housing 11. In the example shown in FIG. 16, the engagement portions 142 include tabs 143. Each tab 143 is received in (hooked into) a respectively corresponding space defined between the interior sidewall of the housing 11 and an inwardly curved portion of the associated bracket 141. In various embodiments, the members 121 are attached to the housing inner sidewalls in various other manners. For example, in some embodiments, a suitable adhesive is used to attach the members 121 to the sidewalls, and spot welding is used in other embodiments.

It can therefore be seen that the spring-loaded spool 120, together with the elongate flexible members 121, the engagement portions 142, and the brackets 141, comprise a follower support apparatus that supports the follower 18A for reciprocal movement within the housing 11. With the magazine spring 14 compressed and the lock buttons 81 (see also FIGS.

8A-8E) engaged in the openings 85 (see also FIG. 15), the downward force of loading (stacking) ammunition rounds onto the follower 18A causes the elongate flexible members 121 to unwrap and extend from the spool 120 against the spring-loading force of the spool. This permits the follower 18A to move downwardly in the housing 11 as the spring-loading force of the spool 120 is overcome. This spool spring force is substantially less than the spring force applied by a magazine spring (such as spring 14), which latter force must be overcome to load a conventional magazine. When the process of loading the magazine is completed, the lock buttons 81 are released from their engagement in the openings 85, thereby permitting the magazine spring 14 to forcibly urge the follower 18A upwardly in the housing 11 to progressively deliver ammunition rounds through the upper end of the housing into the firing chamber of the firearm. During this upward movement of the follower 18A, the spring-loading of the spool 120 causes the elongate flexible members 121 to be retracted and wrapped back onto the spool.

Figure 17:
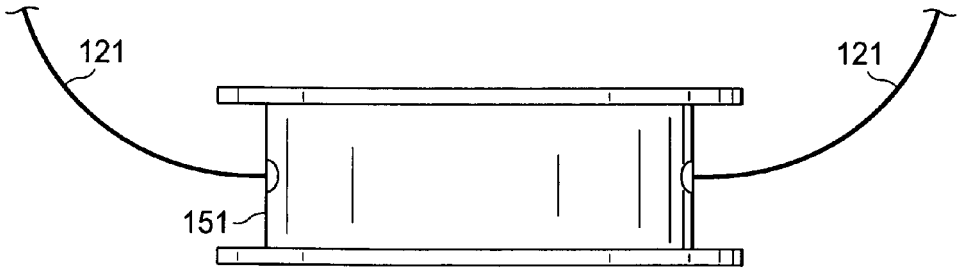

FIG. 17 illustrates the engagement of a spring-loaded spool 151 and the elongate flexible members 121 according to exemplary embodiments of the invention. In FIG. 17, the elongate flexible members 121 are separate and distinct members attached to the spring-loaded spool 151. As the follower 18A moves progressively downwardly in the housing 11 during the process of loading the magazine with ammunition rounds, the elongate flexile members 121 are extended and unwrapped from the spool 120 against the spring-loading of the spool. As the follower 18A moves progressively upwardly in the housing 11 to deliver ammunition rounds into the firing chamber, the elongate flexible members 121 are spooled back onto the spool 120 due to the spring force applied by the spool. The structure and operation of a spring-loaded spool assembly such as shown and described with respect to FIG. 17 is conventional.

Figure 18:
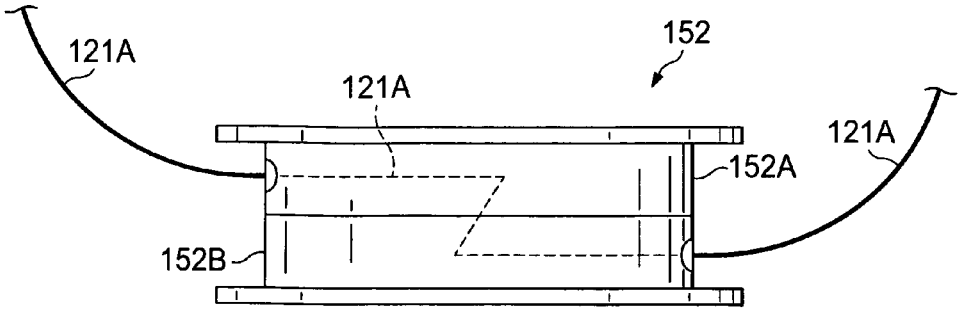

FIG. 18 illustrates the engagement of a spring-loaded spool 152 with a single elongate flexible member 121A (shown diagrammatically with broken line) according to exemplary embodiments of the invention. The spool 152 of FIG. 18 includes two separate, axially adjacent portions 152A (upper) and 152B (lower) which are spring-loaded in respectively opposite circumferential directions. The single, unitary elongate flexible member 121A is wrapped around the spool assembly 152 such that one end of the member 121A extends from the upper portion 152A and the other end of the member 121A extends from the lower portion 152B. The oppositely directed spring-loading of the spool portions 152A and 152B permits the opposite ends of the member 121A to be extended from the spool 152 against the respective spring forces, and retracted back onto the spool 152 by operation of the spring forces. In some embodiments, the two-part spring-loaded spool with single elongate flexible member design shown in FIG. 18 is generally the same design as used in some conventional weed trimmer products.

Figure 19:
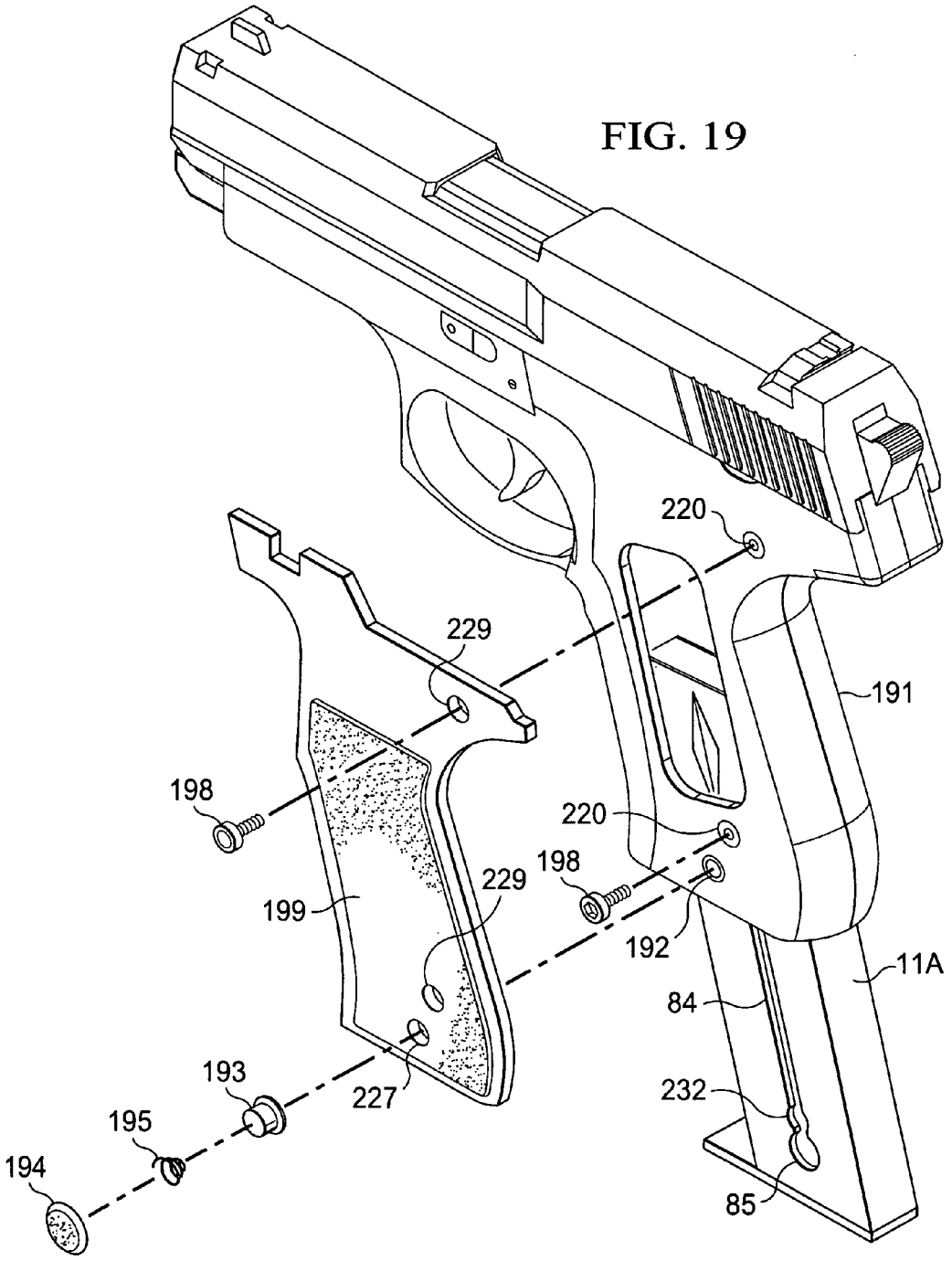
FIGS. 19-22 illustrate firearms according to exemplary embodiments of the invention.

FIG. 19 illustrates a firearm according to exemplary embodiments of the invention, with the grip assembly of the firearm shown in exploded view. As shown in FIG. 19, suitable threaded fasteners 198 pass through openings 229 in a grip cover 199 and engage with threaded openings 220 in a grip portion 191 in order to secure the grip cover 199 to the grip portion 191. The grip cover 199 includes a further opening 227 that receives a spring-loaded stem assembly described in detail below.

Figure 20A:
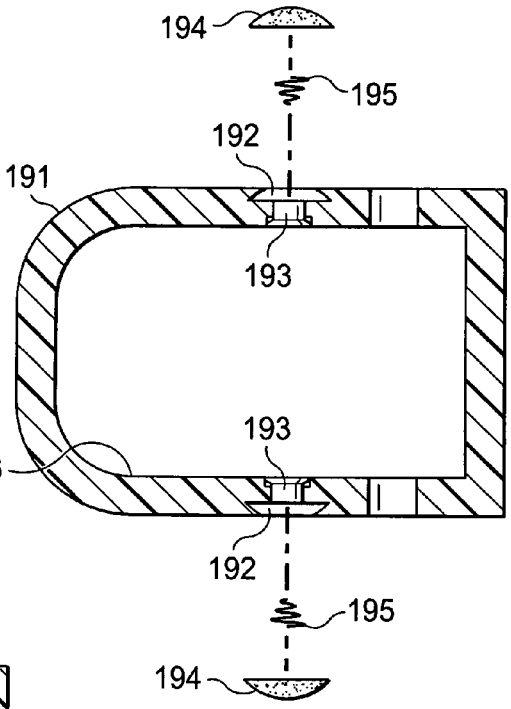
Figure 20B:
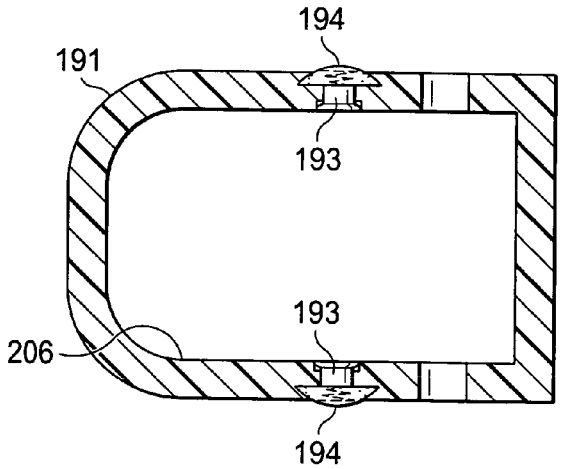
Figure 20C:
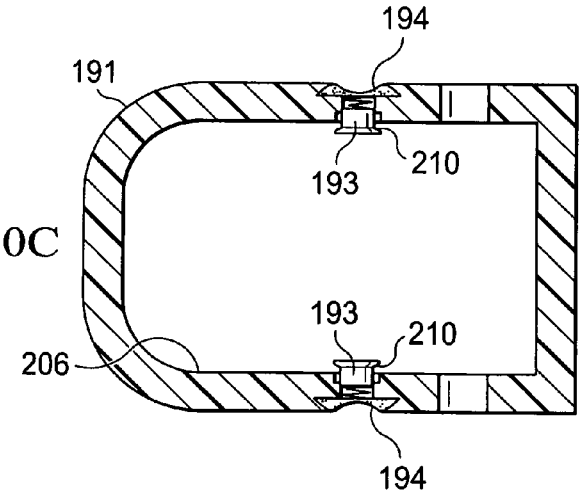

FIG. 20A-20C are cross-sectional views of the grip portion 191 of the firearm of FIG. 19. The grip portion 191 is adapted for use as a spring compression tool for compressing the magazine spring within a magazine housing that implements a follower support apparatus such as those described above. In particular, the grip portion 191 has defined therein a pair of thru holes 192 (FIG. 20A) in opposite sidewalls thereof. The thru holes 192 are generally axially aligned with one another and are adapted to contain respective spring-loaded stems that serve as contact elements for contacting the magazine spring 14 (see also FIGS. 1-3, 14 and 15) in order to force the spring into its locked, compressed position. The stems 193 (FIG. 20C) are spring-loaded in the outward direction of the grip portion 191, and the spring force can be overcome by applying inward pressure with a thumb and forefinger on stem covers 194 that respectively cover the outer ends of the stems 193. The stem covers 194 are elastically compressible as shown in FIG. 20C, and application of thumb and forefinger pressure to the stem covers 194 causes the stems 193 to move against the force of springs 195 for insertion into the interior space 206 of the grip portion 191.

The thru holes 192 are defined with an inner, smaller diameter portion, and an outer, larger diameter portion that are concentric. The inner portion defines therein a generally circular cylindrical space, and the outer portion has a diameter that tapers radially inwardly as the hole 192 extends outwardly through the grip portion 191. The springs 195 have a diameter greater than the diameter of the inner portion of the hole 192. Thus the inner end of each spring 195 engages the grip portion 191 at the juncture of the inner and outer portions of the respectively associated thru hole 192. The outer end of each spring 195 is attached to the outer end of the associated stem 193, so each spring 195 urges its associated stem 193 outwardly, keeping the stem normally withdrawn from the magazine well (i.e., the interior space 206 within the grip portion 191 where the magazine is received), as shown in FIG. 20B. When inwardly directed (e.g., thumb and forefinger) pressure applied to the stem covers 194 overcomes the spring forces, the stems 193 move into the magazine well as shown in FIG. 20C. The type of spring-loaded, pushbutton stem operation described above is conventionally known, being commonly used to implement devices such as pushbutton on/off switches in flashlights.

Figure 21:
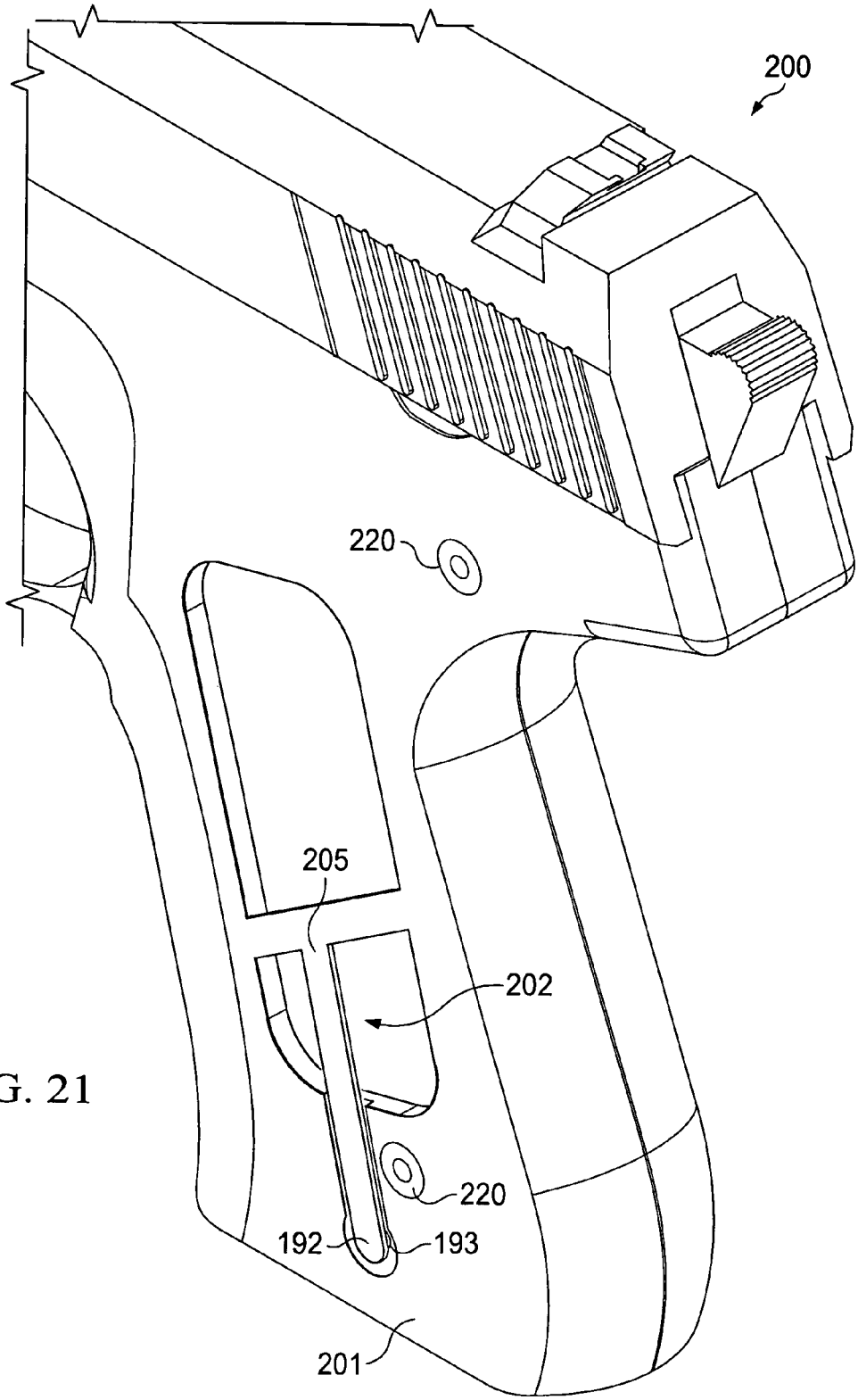

FIG. 21 illustrates a firearm 200 according to exemplary embodiments of the invention. A grip portion 201 of the firearm 200 has anchored near a center point thereof a metal tension strip 202. This tension strip is centrally located on the grip portion 201 and extends downwardly along the central part of the grip portion 201. A lower end of the tension strip 202 has provided thereon a stem 193 (such as also illustrated in FIGS. 19-20C) that extends inwardly toward the magazine well of the firearm via a thru hole 192 (in generally the same manner illustrated in FIGS. 19-20C). Although not explicitly shown in FIG. 21, it will be understood that the opposite side of the grip portion 201 is also analogously provided with another metal tension strip 202 having another stem 193 extending toward the magazine well via another thru hole 192. The metal tension strips 202 are constructed to impart to the stems 193 a slight outwardly directed force. Thus, at 205, the metal tension strip 202 is anchored to and generally flush with the outer surface of the grip portion 201. The outward force of the tension strip 202 causes the stem 193 to be normally withdrawn from the magazine well, with the inner free end 210 of the stem 193 positioned within the thru hole 192.

Figure 22:
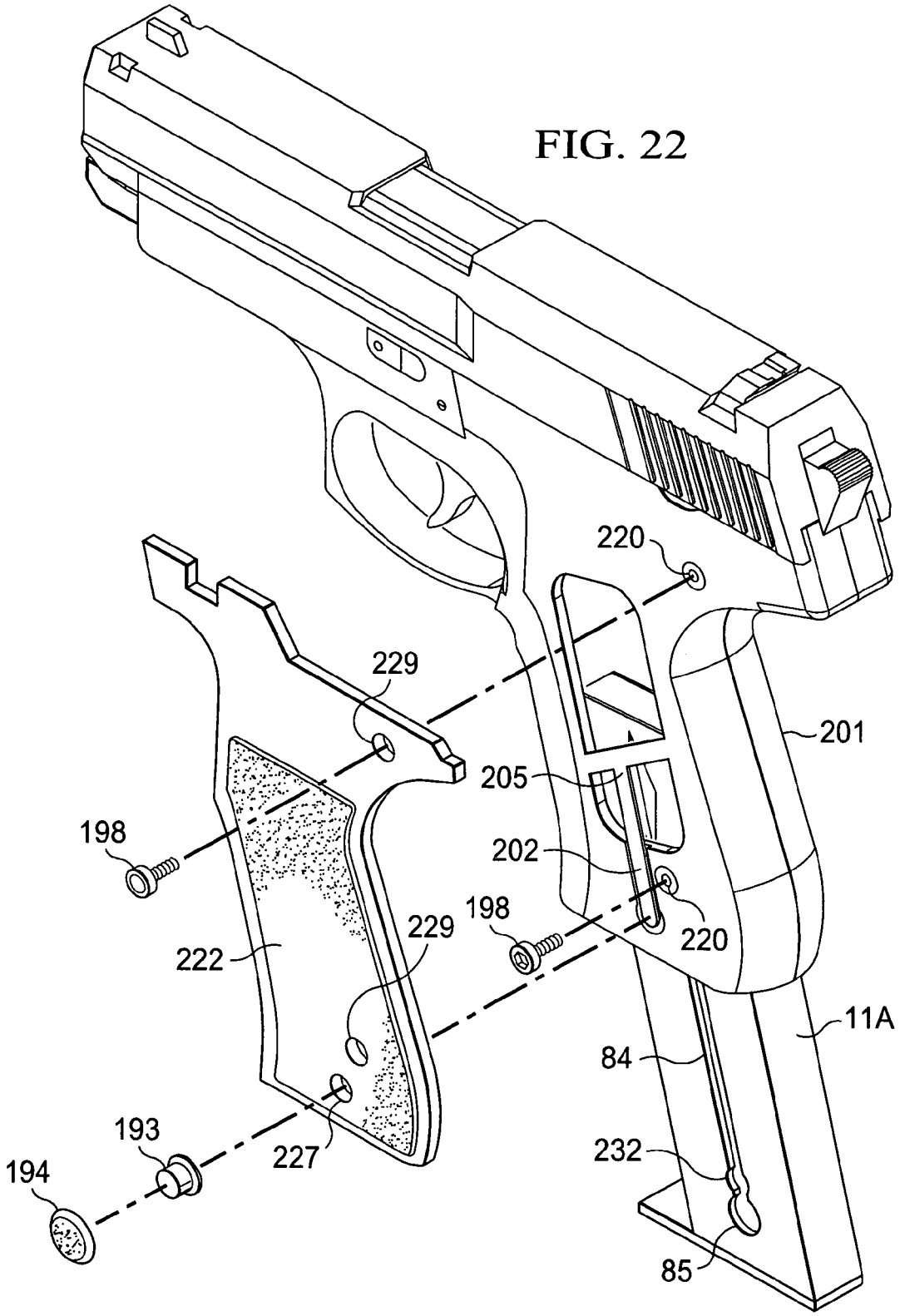

FIG. 22 is similar to FIG. 19, but illustrates the grip assembly for the firearm 200 of FIG. 21. The grip cover 222 of FIG. 22 is substantially similar to the grip cover 199 of FIG. 19 with respect both to its structure and its assembly onto the grip portion 201. Elastically deformable stem cover 194 (such as shown in FIG. 19-20C) facilitates exertion of an inwardly directed force onto the stem 193 provided at the lower end of the tension strip 202.

FIGS. 23A-23E show various views of a lock plate 15B according to exemplary embodiments of the invention. The lock plate 15B is adapted for cooperation with the stems 193 shown in the embodiments of FIGS. 19-22. The lock plate 15B is generally similar to the lock plate 15A of FIGS. 8A-8E, but is slightly larger in order to provide a thru hole 231 above the spring-loaded lock button 81. The thru hole 231 receives the stem 193 when the stem 193 is inserted into the magazine well of the firearm. With the stem 193 received in the thru hole 231, and the magazine spring 14 attached to the lock plate 15B via the curved portion 80 (as described above with respect to lock plate 15A), longitudinal movement of the magazine housing 11A (see FIGS. 19 and 22) relative to the grip portion (191 or 201) causes compression of the magazine spring.

Figure 23A:
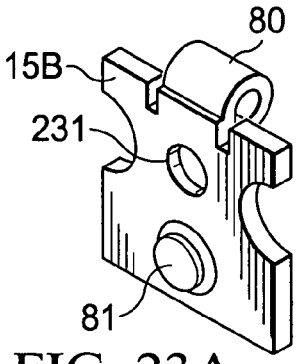
FIGS. 23A-23E illustrate a lock plate for use with the firearms of FIGS. 19-22.
Figure 23B:
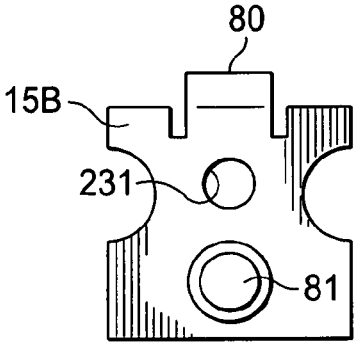
Figure 23C:
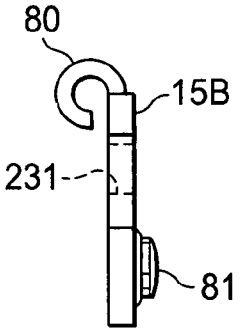
Figure 23D:
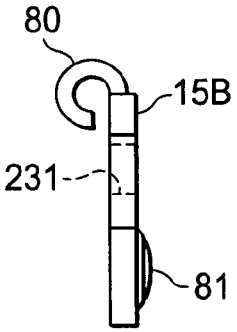
Figure 23E:
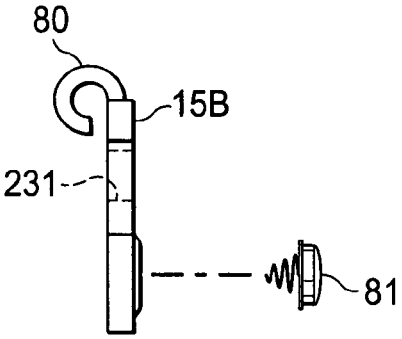
Figure 23F:
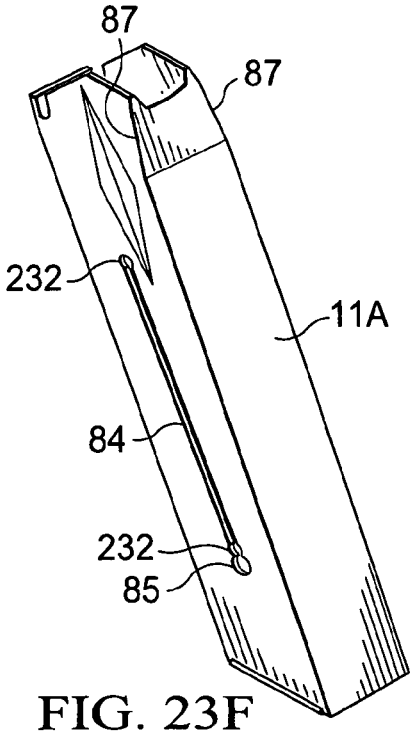
FIG. 23F illustrates a magazine housing for use with the firearms of FIGS. 19-22.

FIG. 23F illustrates an example of the housing 11A that is cooperable with the lock plate 15B for use in the embodiments of FIGS. 19-22. The housing 11A is generally similar to the housing 11 (but without the tapered sidewall portions 87), and can be used interchangeably with the housing 11 to enclose the magazine components illustrated in FIGS. 1-3 and 12-18. In addition to the elongate slot 84 and the opening 85 (see also FIG. 8F), the housing 11A includes further generally circular openings 232 contiguous with the elongate slot 84 at opposite ends thereof. The openings 232 have a smaller radius than the opening 85, and the lower opening 232 is interposed between the elongate slot 84 and the opening 85. The openings 232 have a diameter adequate to receive the radially flanged portions 210 (see FIG. 20C) formed at the inner free ends of the stems 193. With the housing 11A inserted into the magazine well, and with the upper openings 232 axially aligned with the stems 193, the stems 193 can be urged into the openings 232 by thumb and forefinger pressure on the stem covers 194. The upper openings 232 are axially aligned with the openings 231 of the lock plates 15B (FIGS. 23A-23E) when the magazine spring 14 is in its uncompressed state. The lock plate openings 231 receive the stems 193 therein, so that the housing 11A can be moved upwardly into the grip portion to effect compression of the magazine spring 14.

As the housing 11A travels upwardly into the grip portion, the stems 193 travel along the elongate groove 84 securely locked against extraction by the flanged portions 210 (see also FIG. 20C) on their free ends. When the lower openings 232 of the housing 11A become aligned with the stems 193, the thumb and forefinger forces can be removed from the stems 193, so the spring loading of FIG. 19 or the tension strip loading of FIG. 22 withdraws the stems 193 from the housing 11A through the lower openings 232. This returns the stems 193 to their original positions within the thru holes 192, completely withdrawn from the magazine well. Also, when the housing 11A is positioned such that the stems 193 can be withdrawn through the lower openings 232 of the housing 11A, the lock buttons 81 of the lock plates 15B are aligned with the openings 85 in the housing 11A. Thus, the spring loading of the lock buttons 81 causes the lock buttons 81 to enter into the respective openings 85 and thereby engage the sidewall of the housing 11A in the same manner described above with respect to engagement of the lock plates 15A with the housing 11. At this point, the housing 11A can be withdrawn from the grip portion, ready to be loaded with ammunition rounds.

The housing 11 described above, with or without the tapered sidewall portions 87, may of course also be used in the firearms of FIGS. 19-22. In such instances, tools such as described above may be used to compress the magazine spring 14.

In all described embodiments, after the magazine has been loaded with ammunition rounds, the lock buttons 81 can be released from their engagement in the openings 85 of the housing 11 or 11A in any desired manner (e.g., thumb and forefinger pressure on the buttons 81), thereby releasing the magazine spring 14 from its compressed position and causing it to forcibly urge the ammunition rounds towards the open end of the housing 11 or 11A in a generally convention fashion. In addition, as the loaded magazine housing is being inserted into the magazine well, the spring-loaded stem assemblies of FIGS. 19-22 may be operated to apply inward releasing forces to the lock buttons 81.

Figure 24:
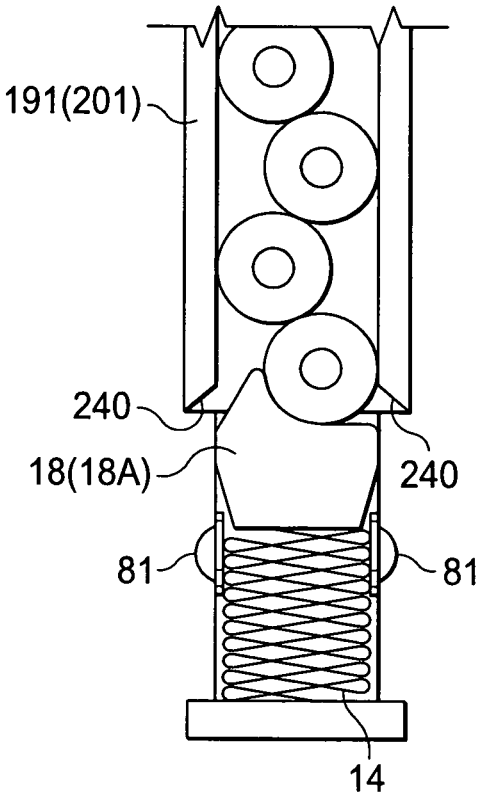
FIGS. 24 and 24A illustrate the release of lock buttons when a loaded magazine is inserted into a magazine well of a firearm according to exemplary embodiments of the invention.

FIG. 24 is a cross sectional view of part of a grip portion of a conventional firearm (or one of the grip portions 191, 201). As shown in FIG. 24, the sidewalls of the grip portion define respective bevels at the lower, open end of the grip portion where the magazine is received. These beveled portions 240 of the sidewalls will impart inwardly directed forces onto the lock buttons 81 when the lock buttons 81 reach the beveled portions 240 during insertion of the housing 11 or 11A into the magazine well of the grip portion. The sidewalls of the grip portion maintain this inwardly directed force on the buttons 81 while the housing 11 or 11A remains within the magazine well. Accordingly, the lock buttons 81 are disengaged from the housing to release the compression spring 14 by the mere action of inserting the housing 11 or 11A into the magazine well. It will be recognized that the sidewalls of the housing 11 (11A) and various components within the housing are omitted in FIG. 24 in order not to obscure how the lock buttons 81 are released when the housing is inserted into the magazine well.

Figure 25:
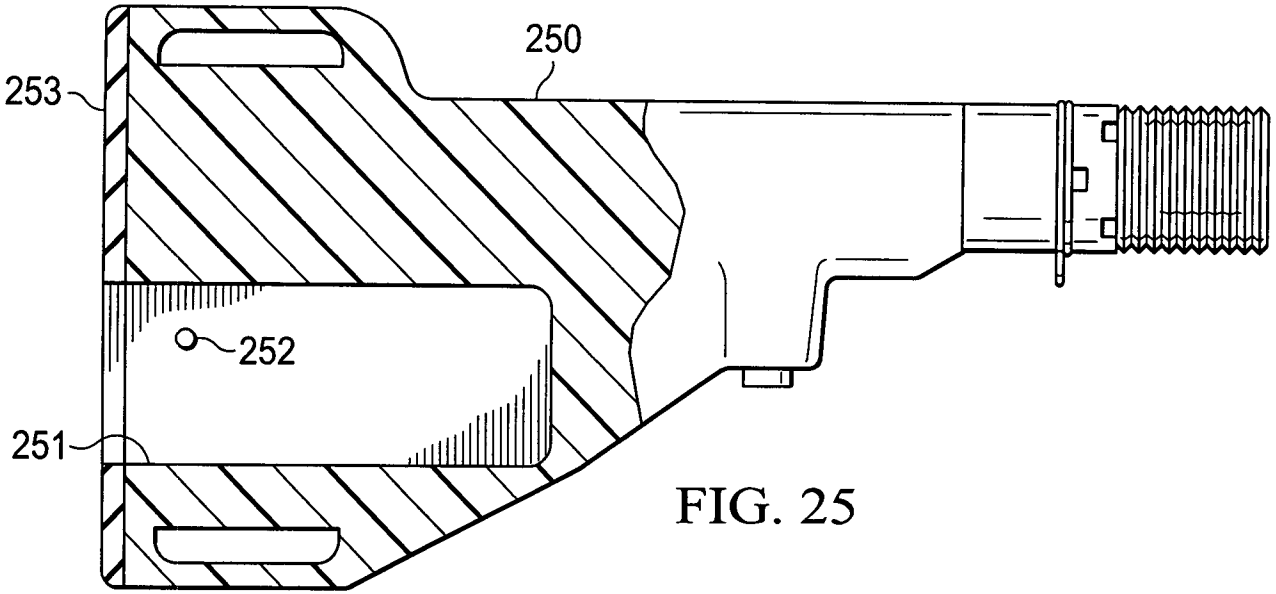
FIGS. 25-30 illustrate portions of firearms according to exemplary embodiments of the invention.
Figure 25A:
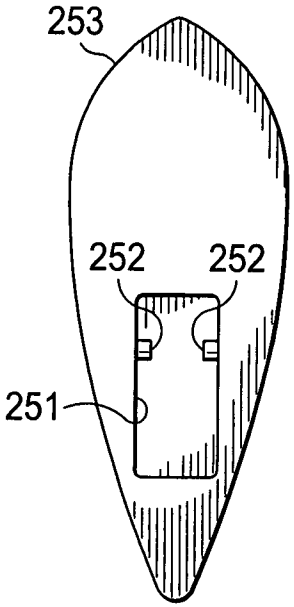

FIGS. 25 and 25A illustrate a portion of a firearm according to exemplary embodiments of the invention. The firearm of FIGS. 25 and 25A (e.g., a rifle) includes a stock 250 which defines therein a longitudinally extending blind opening 251. A portion of the stock 250 is omitted in FIG. 25 to show the opening 251. A pair of contact portions 252 extend from the stock into the opening 251 in generally opposed relationship to one another. FIG. 25A is an end view of the stock 250, showing that the opening 251 extends through the butt plate 253 of the stock to permit insertion of the magazine housing through the butt plate 253. Insertion of magazine housing 11 longitudinally (left-to-right in FIG. 25) into the opening 251 permits the contact portions 252 to be inserted into the housing 11 in generally the same manner described above with respect to the spring compression tools of FIGS. 9 and 10, thereby causing the desired compression of the magazine spring 14. The housing 11 can then be withdrawn from the opening 251, ready to be loaded with ammunition rounds.

Figure 26:
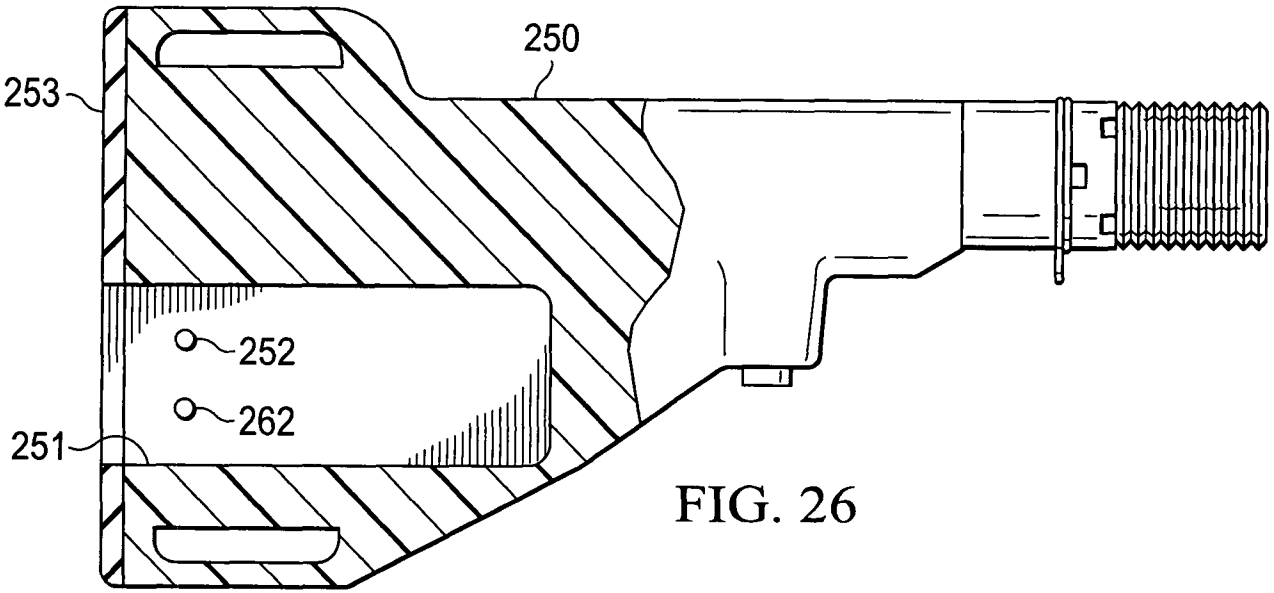
Figure 26A:
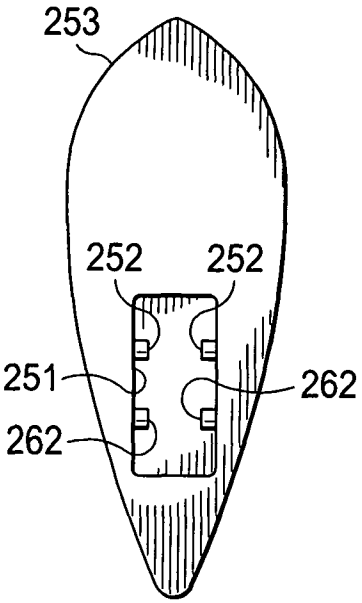

FIGS. 26 and 26A illustrate a firearm generally similar to that of FIGS. 25 and 25A, except an additional pair of generally opposed contact portions 262 also protrude into opening 251. The additional pair of contact portions 262 can be useful for the relatively large magazine housings as would be used with firearms such as shown in FIGS. 25-26A. Embodiments that exploit the additional protrusions 262 also provide in each sidewall of the magazine housing an additional elongated groove 84 (generally parallel to the one shown in FIG. 8F) for receiving the additional pair of protrusions.

Figure 27:
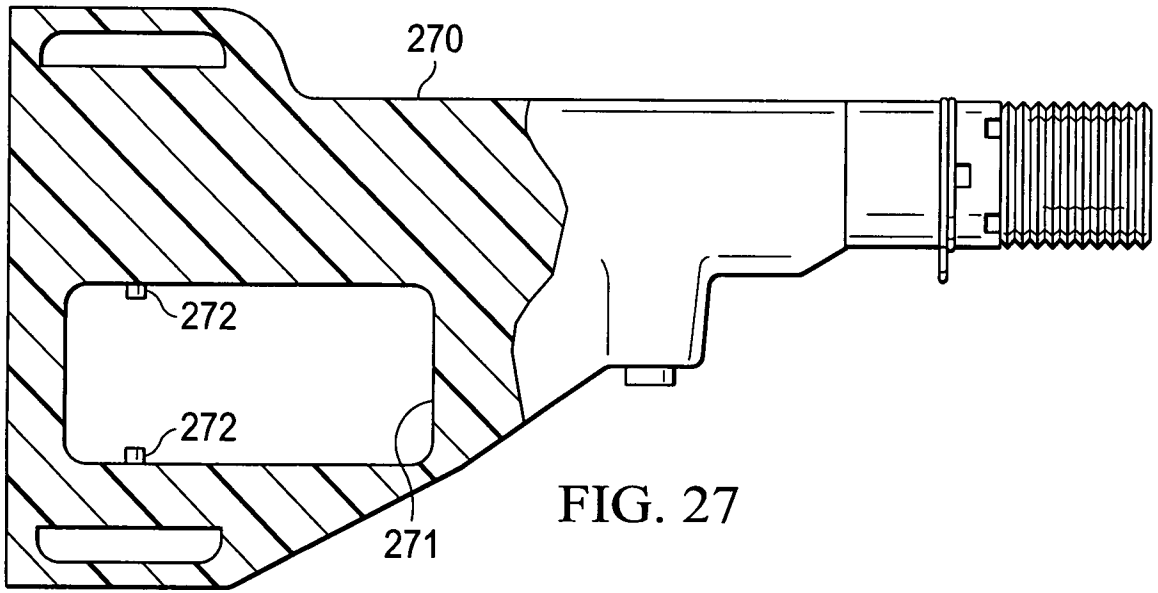

FIG. 27 illustrates a portion of a firearm according to exemplary embodiments of the invention. The stock 270 of the firearm of FIG. 27 defines therein a thru opening 271 extending transversely through the stock 270. A pair of protrusions 272 extend from the stock into the opening 271 in generally opposed relationship for insertion into slots 84 to contact and compress the magazine spring 14 as the magazine housing 11 is inserted transversely through the opening 271.

Figure 28:
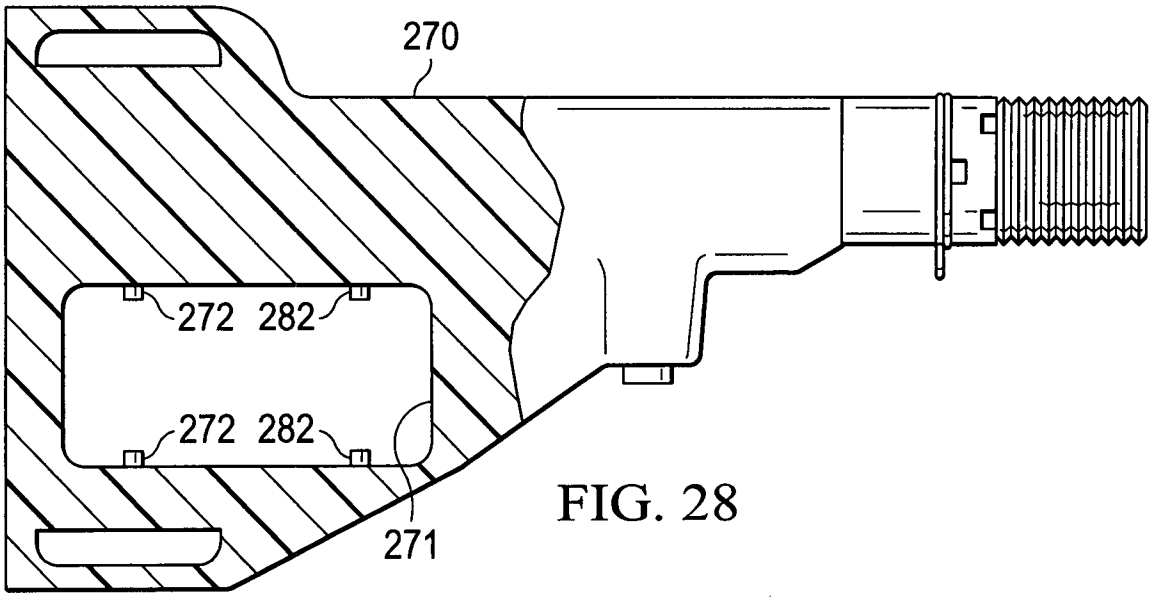

FIG. 28 illustrates a firearm according to exemplary embodiments of the invention. The firearm of FIG. 28 is generally similar to that of FIG. 27 but includes an additional pair of contact portions 282 protruding into the opening 271 to facilitate compressing the magazine spring of larger magazines associated with firearms such as illustrated in FIGS. 27 and 28. Embodiments that exploit the additional protrusions 282 also provide in each sidewall of the magazine housing an additional elongated groove 84 (generally parallel to the one shown in FIG. 8F) for receiving the additional pair of protrusions.

Figure 29:
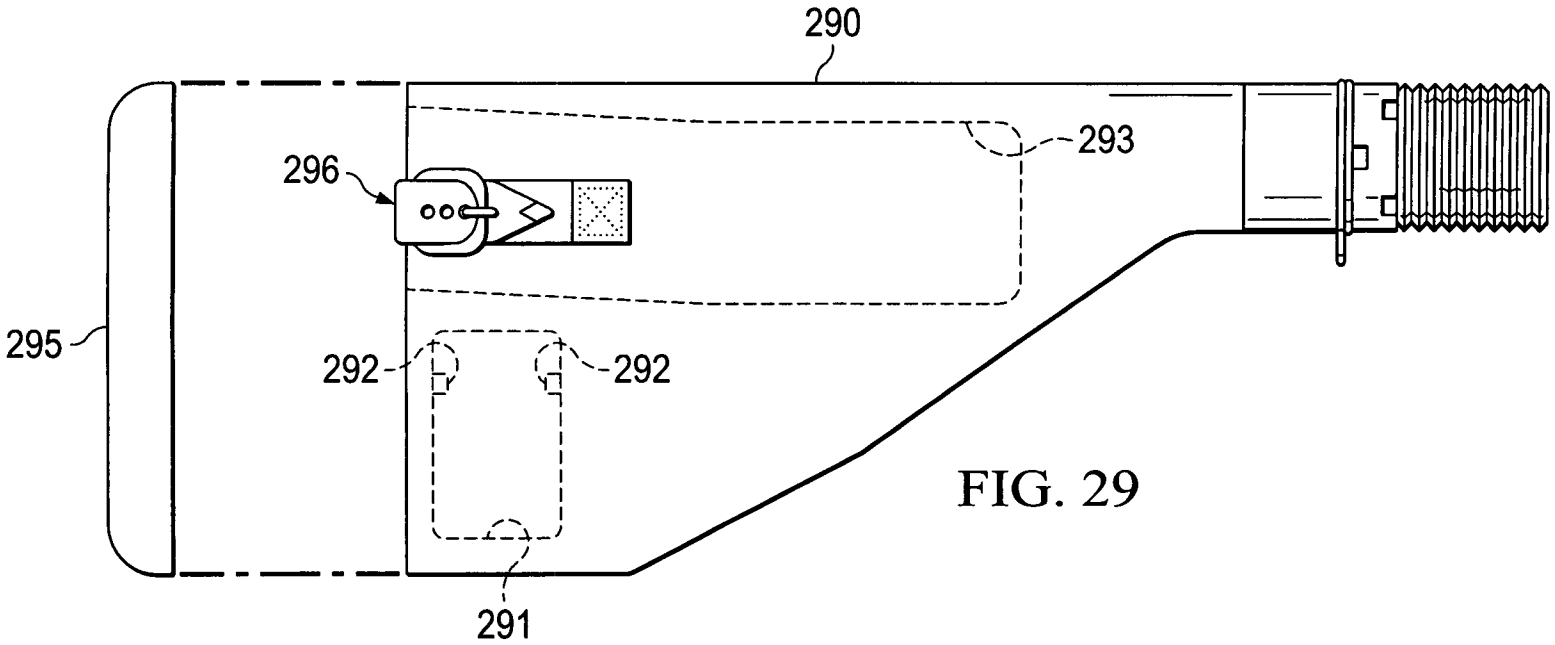

FIG. 29 illustrates a portion of a firearm according to exemplary embodiments of the invention. The stock 290 has defined therein a transversely extending thru opening 291. A pair of generally opposed contact portions 292 protrude into the thru opening for engaging and compressing the magazine spring as the housing is inserted transversely through the opening 291. The stock of FIG. 29 further defines therein a cavity 293 located above the thru opening 291 for storing a magazine or other desired object(s). A rubber butt pad 295, which is conventionally fitted into the rear of a stock and fixedly secured to the stock with a suitable adhesive, is instead fitted into the rear of the stock 290 and removably secured in position by any suitable arrangement, for example a strap and buckle arrangement shown generally at 296 in FIG. 29. The removable butt pad 295 provides convenient access to the storage cavity 293. In some embodiments, the opening 291 is rotated 90 degrees relative to that shown in FIG. 29.

Figure 30:
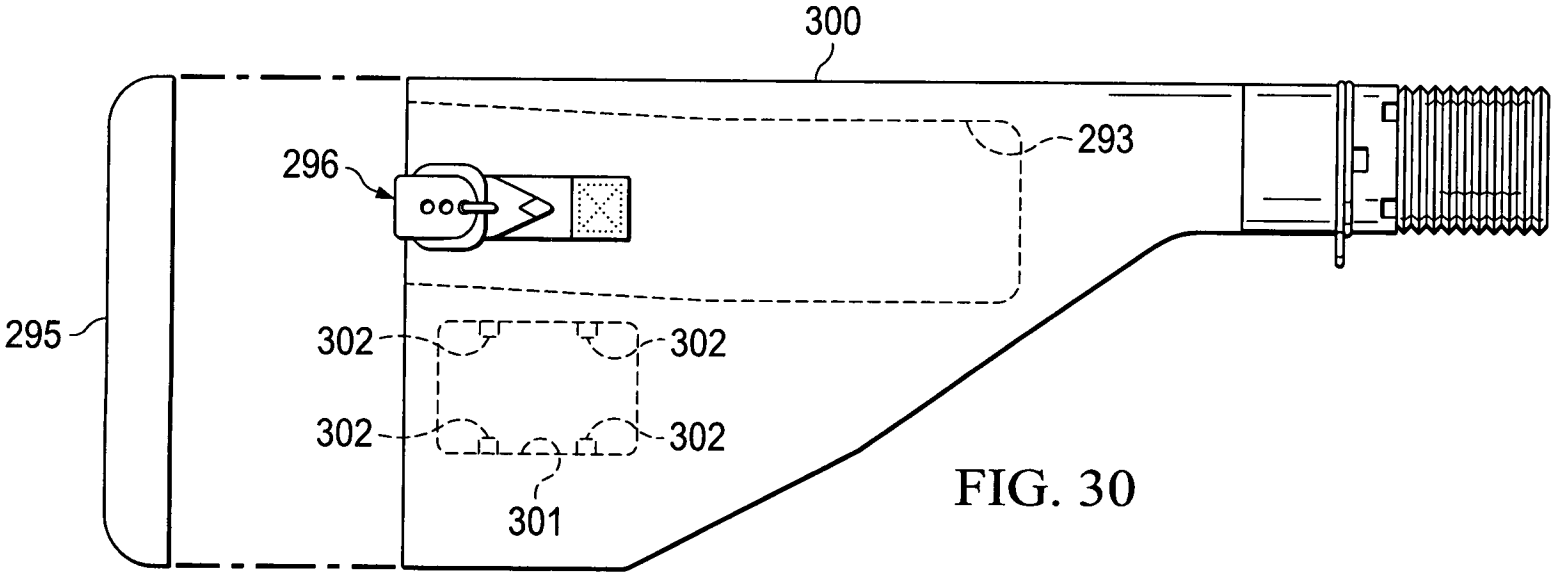

FIG. 30 illustrates a portion of a firearm generally similar to that of FIG. 29, but including a thru opening 301 extending transversely through the stock 300 and having two pairs of generally opposed contact portions 302 protruding from the stock into the opening 301. In some embodiments, the opening 301 is rotated 90 degrees relative to that shown in FIG. 30.

Figure 31:
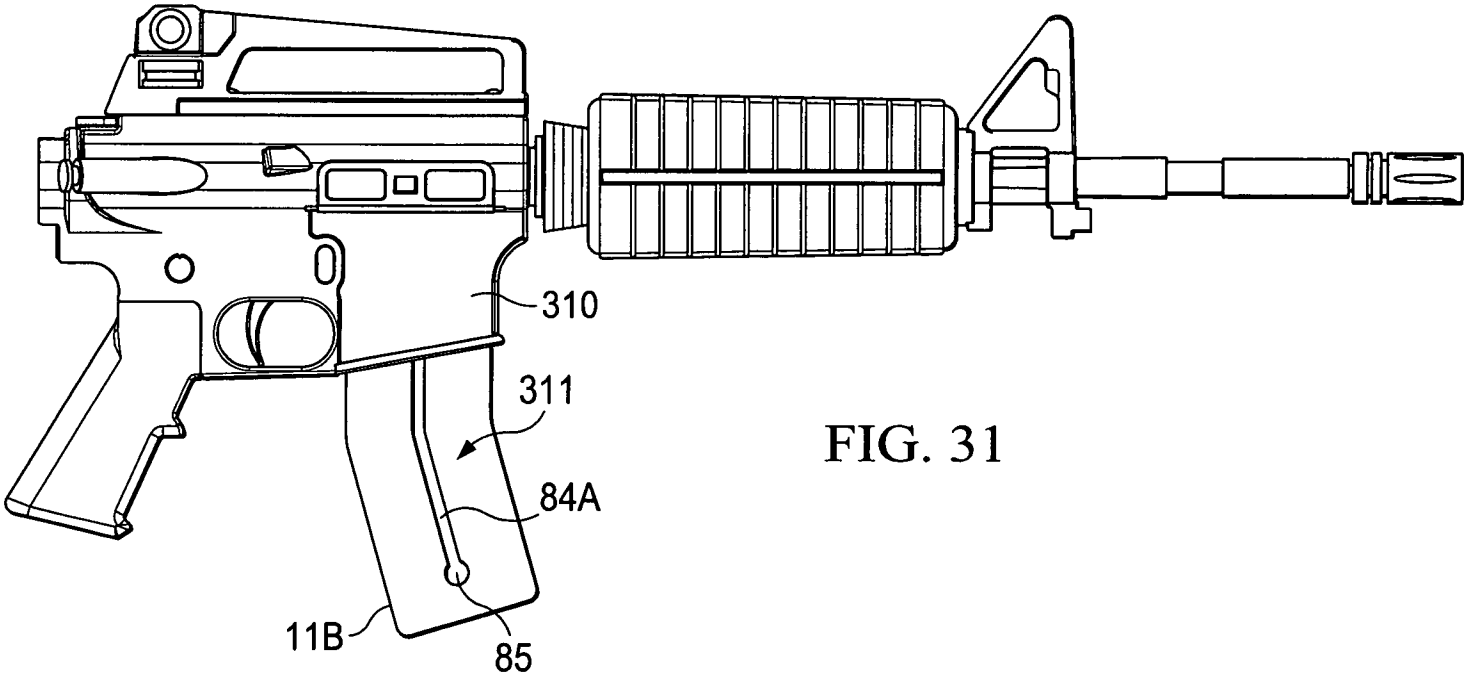
FIG. 31 illustrates a remainder of a firearm for use with the firearm portions of FIGS. 25-30 according to exemplary embodiments of the invention.

FIG. 31 illustrates the remainder of a firearm that attaches in conventional fashion to a stock such as shown in FIGS. 25-28 to produce a complete firearm (e.g., a rifle). The magazine housing 11B has provided in each sidewall thereof an elongated slot 84A having an opening 232 contiguously adjoining its lower end. The slots 84A (only one of which is visible in FIG. 31) conform to the shape of the housing 11B, having a slight bend at 311. The magazine housing 11B is not completely received within the magazine well portion 310, so a substantial portion of the slot 84A is exposed outside the magazine well portion 310. In some embodiments that use the telescoping member 16, the hole 63 (see FIGS. 6 and 7) is large enough to accommodate the slight pivoting that the follower 18 experiences as it travels past the bend at 311. In some embodiments, the bottom of the telescoping member 16 is secured to the bottom of the housing 11B at a position offset slightly toward the stock (relative to the position shown in FIGS. 1-3) in order to accommodate pivoting by the follower 18. In some embodiments, the bottom section of the telescoping member 16 is provided with a ball pivot joint similar to that used to pivot the telescoping antenna of a conventional portable radio.

Figure 32:
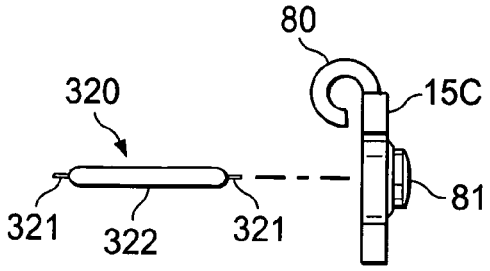
FIGS. 32-34 illustrate embodiments having an alternative lock plate arrangement for locking and releasing the magazine spring.
Figure 33:
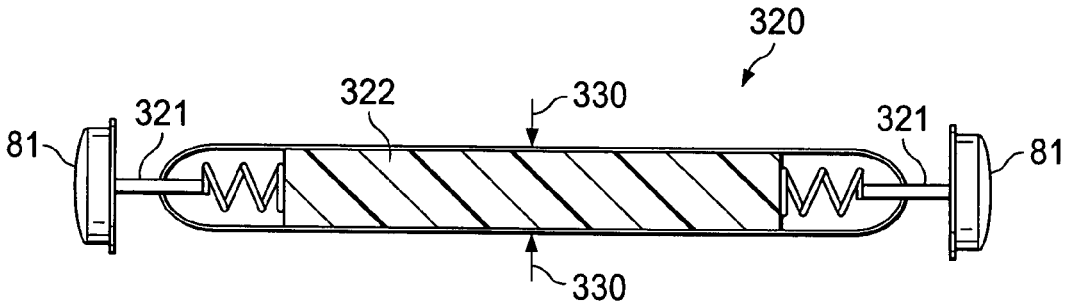

FIG. 32 illustrates further embodiments of the lock plate 15 (see also FIGS. 1 and 14). In some embodiments, the lock plate 15C of FIG. 32 is generally similar in construction to lock plates 15A (FIGS. 8A-8E) and 15B (FIGS. 23A-23E), but the lock button 81 is not itself spring-loaded. Instead, it is mounted in the lock plate 15C so as to be urged outwardly (rightwardly in FIG. 32) by a spring-loaded pin assembly 320. In some embodiments, as shown in FIG. 33, the pin assembly 320 is constructed generally similarly to pin assemblies such as are conventionally used to secure a watch band to a wristwatch. Spring-loaded pins 321 extend outwardly from an elongate central body 322 that houses therein springs which load the respective pins 321.

The pins 321 engage the lock buttons 81 in any suitable fashion, in order to urge the lock buttons outwardly. In some embodiments, the free ends of the pins are received in corresponding receptacle holes (not explicitly shown) formed in inner surfaces of the lock buttons 81. In some embodiments, the free ends of the pins 321 are flanged to provide outwardly facing surfaces (not explicitly shown) suitable to contact the inner surfaces of the lock buttons 81 over a surface area sufficient to produce a stable engagement between the pin and the lock button.

Figure 24A:
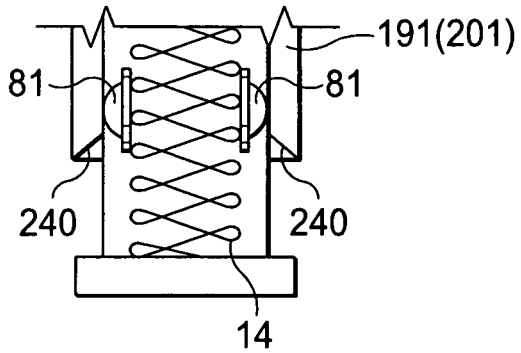
Figure 34:
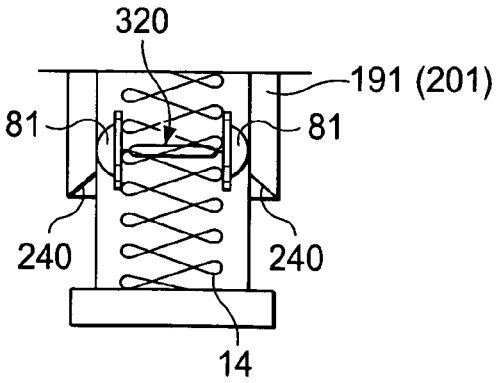

FIG. 34 is similar to FIG. 24A, and illustrates the pin assembly 320 engaged between the lock buttons 81 within the magazine well. FIG. 34 further illustrates that pin assembly 320 extends laterally across the magazine well such that it does engage the magazine spring 14 when the spring is compressed. However, the physical dimension 330 of the central body 322 is small enough (e.g., about the size of a thick watchband pin) to avoid any significant interference with compression of the magazine spring 14.

Figure 35:
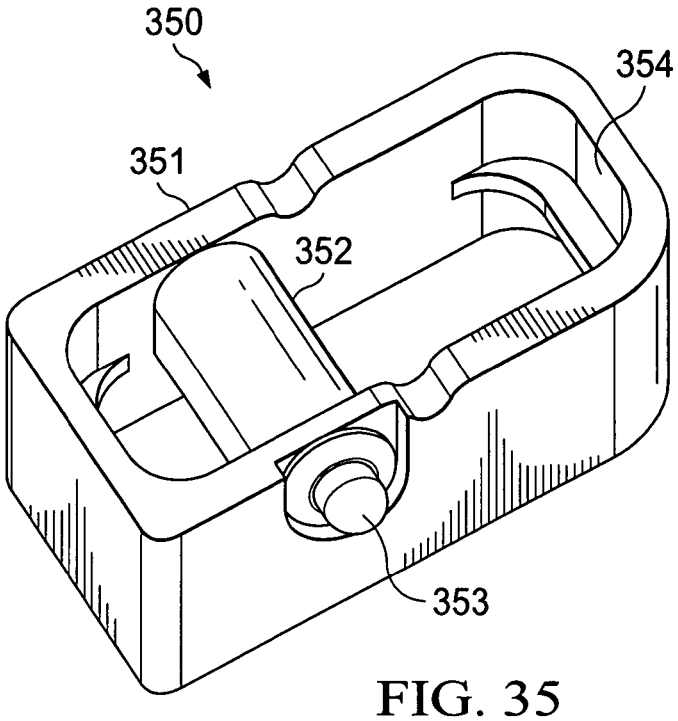
FIGS. 35 and 36 diagrammatically illustrate a locking assembly according to example embodiments of the present work.
Figure 36:
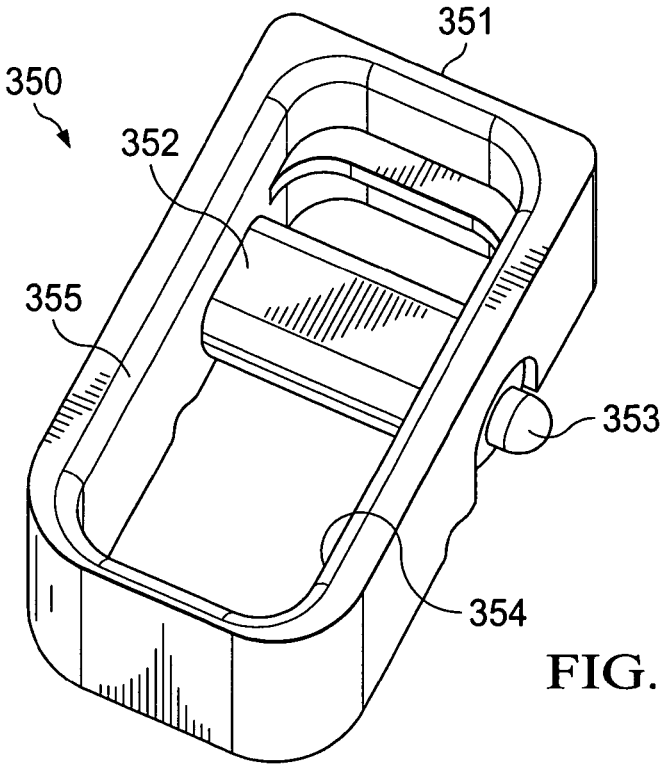

FIGS. 35 and 36 diagrammatically illustrate a locking assembly 350 for releasably locking the magazine spring 14 to one of the sidewalls of the housing 11 (see also, e.g., FIG. 1) according to further example embodiments of the present work. The locking assembly 350 may be employed as an alternative to any of the above-described mechanisms for releasably locking the compressed magazine spring 14 to the sidewalls of the housing 11 (see, e.g., 15 in FIG. 1, and 15C/320 in FIGS. 32 and 33). The locking assembly 350 includes a pin carrier 351 that supports a spring-loaded pin assembly 352 having an end portion 353 configured to extend into one of the openings 85 in the housing 11 (see also FIG. 8F). In some embodiments, the end portion 353 is constructed similarly to the pins 321 described above relative to FIGS. 32 and 33, but has approximately the same diameter as the lock buttons 81. In some embodiments, the pin carrier 351 is constructed from the same molded plastic material as a conventional follower.

Figure 38:
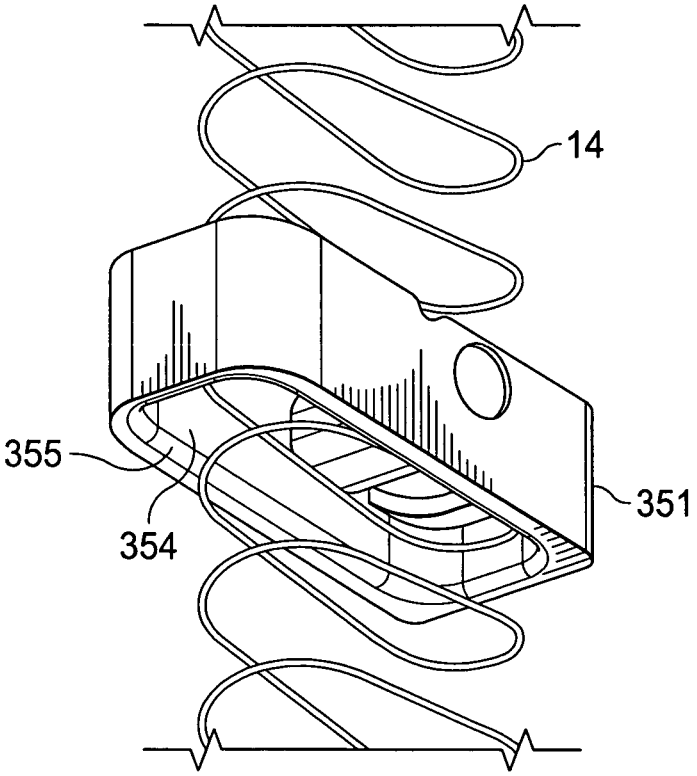
FIG. 38 diagrammatically illustrates the magazine spring received in and extending through the locking assembly of FIGS. 35 and 36 according to example embodiments of the present work.

The pin carrier 351 has a generally annular structure with an outer perimeter that is generally conformal with, and slightly smaller than, a transverse cross-sectional profile of the interior of housing 11. This configuration permits the locking assembly 350 to be received inside housing 11 for movement therein, where the movement of the locking assembly 350 is guided by the close conformity between the outer perimeter of the pin carrier 351 and the interior profile of the housing 11. As shown also in FIG. 36, the pin carrier 351 defines therein a central opening 354 to allow the magazine spring 14 to pass through the locking assembly 350. This is also shown in FIG. 38. Referring again to FIGS. 35 and 36, the spring-loaded pin assembly 352 extends completely across the central opening 354. FIG. 36 also shows that the pin carrier 351 has formed therein a spring seat 355 extending along and surrounding the central opening 354. The spring seat 355 is configured to engage and seat against a selected coil of the magazine spring 14. When the pin carrier 351 is received within the housing 11 and the spring seat 355 is seated against the selected coil of spring 14, the end portion 353 of the spring-loaded pin assembly 352 is urged against one sidewall of the housing 11.

When seated on the spring 14 with the end portion 353 urged against a sidewall of housing 11, the locking assembly 350 operates analogously to the various arrangements of lock buttons 81 described above. That is, as the pin carrier 351 moves downwardly in the housing 11 with compression of the spring 14 (by a tool such as shown, e.g., in FIG. 9 or 10), the end portion 353 eventually becomes aligned with the opening 85 in the sidewall against which it is engaged. The spring-loading then forces the end portion 353 outwardly into the opening 85 to lock the spring 14 into a compressed position in the lower part of the housing 11 (see also, e.g., FIG. 2). After the magazine is loaded with ammunition rounds, the end portion 353 may then be pushed inwardly, from outside the housing 11, to release the engagement between the end portion 353 and the opening 85, thereby releasing the spring 14.

Some embodiments dispense with follower supports such as described above, and instead adjust the position of the unitary magazine spring 14 to reduce the urging force that the spring 14 applies to the follower during loading of ammunition rounds. This reduces the forces encountered during ammunition loading, thereby permitting easier loading than conventional magazines. Such embodiments locate the locking mechanism (e.g., 15 of FIG. 1, 15C/320 of FIG. 32-34, or 350 of FIGS. 35 and 36) at a coil of the spring 14 that is selected to permit the spring 14 to remain engaged against the follower even after the spring 14 has been compressed into the lower part of the housing and locked to the housing sidewall. This is shown diagrammatically in FIG. 37.

Figure 37:
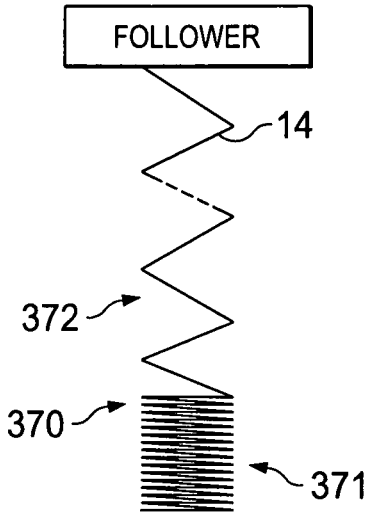
FIG. 37 diagrammatically illustrates positional adjustment of the magazine spring to reduce the urging force that the spring applies to the follower according to example embodiments of the present work.

In FIG. 37, the spring 14 is shown in its compressed position, already locked to the housing (not explicitly shown). Reference numeral 370 designates the selected coil of the spring 14 where the spring is locked to the housing by the locking mechanism (not explicitly shown). As is evident from FIG. 37, the coil at 370 is selected to permit the spring 14 to remain engaged against the follower after the spring 14 has been compressed and locked to the housing. The lower portion 371 of the spring 14 (the portion below coil 370) is compressed substantially more than is the upper portion 372 of the spring 14 (the portion above coil 370). Moreover, it is evident that the less-compressed upper portion 372 urges less forcibly against the follower than does the spring 14 when the lower portion 371 is not compressed and locked as shown. Thus, the forces required to load successive ammunition rounds are reduced by the positional adjustment of the spring 14 illustrated in FIG. 37. After loading is complete, the locking mechanism is operated to release the spring 14 for cooperation with the follower in conventional fashion to deliver ammunition rounds to the firing chamber.

Although exemplary embodiments of the invention have been described above in detail, this does not limit the scope of the invention, which can be practiced in a variety of embodiments.

What is claimed is:

1. A magazine apparatus for delivering ammunition rounds into a firing chamber of a firearm, comprising:

a housing configured for insertion into a magazine well of the firearm;

a follower disposed and movably supported within said housing, said follower configured to support thereon a stack of ammunition rounds within said housing;

a spring disposed within said housing for forcibly urging said follower and the stack of ammunition rounds toward the firing chamber when said housing is inserted in the magazine well;

said housing having a pair of opposed sidewalls that face one another in a direction generally transverse to a compression direction of said spring; and a locking assembly carried on said spring at a position intermediate opposite ends of said spring, said locking assembly cooperable with one of said sidewalls to releasably lock said spring to said housing with first and second portions of said spring relatively less and more compressed, respectively.

2. The apparatus of claim 1, wherein said locking assembly includes a pair of spring-loaded buttons configured to extend into respective openings in the respective sidewalls.

3. The apparatus of claim 2, wherein each of said buttons is spring-loaded separately from the other of said buttons.

4. The apparatus of claim 2, wherein said buttons are spring-loaded by a common spring.

5. The apparatus of claim 4, wherein said locking assembly includes a spring-loaded pin assembly that contains said common spring and has opposite end portions that respectively engage said buttons.

6. The apparatus of claim 2, wherein said buttons are provided on respective plates secured to said spring.

7. The apparatus of claim 1, wherein said locking assembly includes a spring-loaded pin assembly.

8. The apparatus of claim 7, wherein said spring-loaded pin assembly has an end portion configured to extend into an opening in said one sidewall.

9. The apparatus of claim 7, wherein said locking assembly includes a pin carrier seated on said spring, and wherein said spring-loaded pin assembly is supported on said pin carrier.

10. The apparatus of claim 9, wherein said pin carrier has a generally annular structure.

11. A magazine apparatus for delivering ammunition rounds into a firing chamber of a firearm, comprising:

a housing configured for insertion into a magazine well of the firearm;

a follower disposed and movably supported within said housing, said follower configured to support thereon a stack of ammunition rounds within said housing;

a unitary spring disposed within said housing for forcibly urging said follower and the stack of ammunition rounds toward the firing chamber when said housing is inserted in the magazine well;

a locking assembly carried on said spring at a position intermediate opposite ends of said spring, said locking assembly cooperable with said housing to releasably lock said spring to said housing with first and second portions of said spring relatively less and more compressed, respectively.

12. The apparatus of claim 11, wherein said locking assembly includes a pair of spring-loaded buttons configured to extend into respective openings in said housing.

13. The apparatus of claim 12, wherein each of said buttons is spring-loaded separately from the other of said buttons.

14. The apparatus of claim 12, wherein said buttons are spring-loaded by a common spring.

15. The apparatus of claim 14, wherein said locking assembly includes a spring-loaded pin assembly that contains said common spring and has opposite end portions that respectively engage said buttons.

16. The apparatus of claim 12, wherein said buttons are provided on respective plates secured to said spring.

17. The apparatus of claim 11, wherein said locking assembly includes a spring-loaded pin assembly.

18. The apparatus of claim 17, wherein said spring-loaded pin assembly has an end portion configured to extend into an opening in said housing.

19. The apparatus of claim 17, wherein said locking assembly includes a pin carrier seated on said spring, and wherein said spring-loaded pin assembly is supported on said pin carrier.

* * * * *